US007507061B2

(12) United States Patent
Wells et al.

(10) Patent No.: US 7,507,061 B2
(45) Date of Patent: Mar. 24, 2009

(54) MODULAR INTER-MODAL PLATFORM (MIP)

(75) Inventors: James S. Wells, Fountain Valley, CA (US); Anibal J. Garcia, Chino, CA (US); Myles A. Rohrlick, San Diego, CA (US); John B. Simmons, Corona, CA (US)

(73) Assignee: The Boeing Company, Chicago, IL (US)

( * ) Notice: Subject to any disclaimer, the term of this patent is extended or adjusted under 35 U.S.C. 154(b) by 519 days.

(21) Appl. No.: 11/270,356

(22) Filed: Nov. 9, 2005

(65) Prior Publication Data

US 2007/0104562 A1 May 10, 2007

(51) Int. Cl.
*B60P 7/06* (2006.01)

(52) U.S. Cl. ..... 410/46

(58) Field of Classification Search ..... 410/46, 410/66, 71, 74, 75, 76, 77, 80, 90, 91, 92; 248/346.02, 346.5

See application file for complete search history.

(56) References Cited

U.S. PATENT DOCUMENTS 3,429,536 A * 2/1969 Weingarten et al. ..... 410/77
3,508,764 A * 4/1970 Bexon et al. ..... 410/90
3,741,504 A * 6/1973 Alberti et al. ..... 244/137.1
3,899,092 A * 8/1975 Nordstrom ..... 410/87
5,799,585 A * 9/1998 Brennan et al. ..... 108/53.1
6,561,739 B1 * 5/2003 Garala ..... 410/46
6,698,607 B2 * 3/2004 Brennan, Jr. ..... 220/1.5
6,817,578 B1 11/2004 Garcia et al.
6,821,068 B2 * 11/2004 Facey et al. ..... 410/100
6,824,338 B2 * 11/2004 Looker ..... 410/67
2003/0143052 A1 * 7/2003 Fehrle et al. ..... 410/46
2004/0018067 A1 * 1/2004 Taylor et al. ..... 410/46
2007/0217883 A1 * 9/2007 Heinrichs et al. ..... 410/80

* cited by examiner

*Primary Examiner*—H Gutman
(74) *Attorney, Agent, or Firm*—Harness, Dickey & Pierce, P.L.C.

(57) ABSTRACT

A pallet system for loading and supporting cargo is provided. The pallet system includes a cargo pallet having an upper surface, a lower surface along with a pair of oppositely disposed longitudinal sides having forklift slots generally formed between the upper and lower surfaces, and a pair of oppositely disposed ends generally interconnecting said upper surface and said lower surface. A plurality of drop-down rails is configured to convert the lower surface from a flat bottom to a non-planar bottom. A plurality of extendable rails is used to extend a width of the cargo pallet. A locking mechanism enables the cargo pallet to be coupled to another cargo pallet. A collapsible bale arm assembly can be removed from the cargo pallet when the cargo pallet is stored.

36 Claims, 24 Drawing Sheets

FIG 20
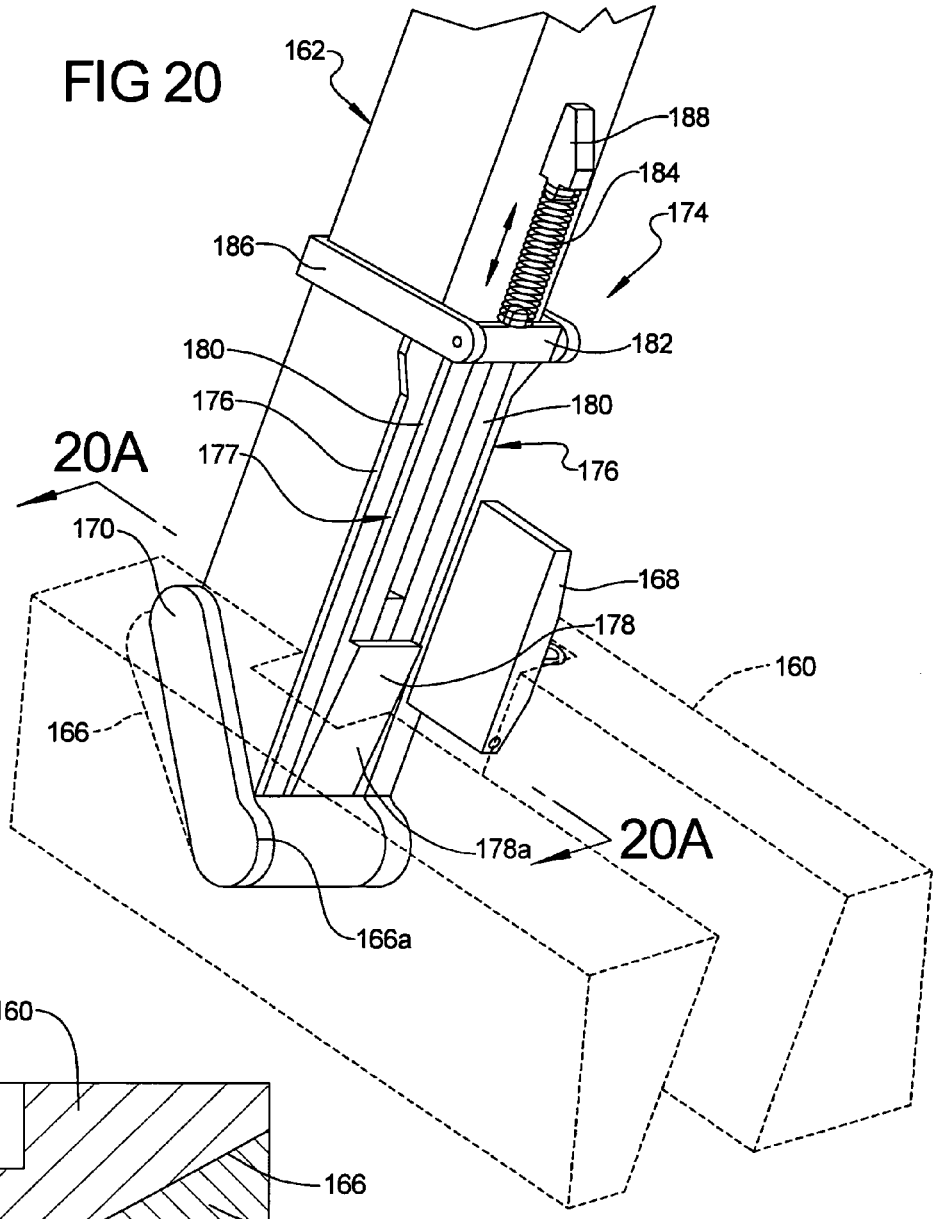
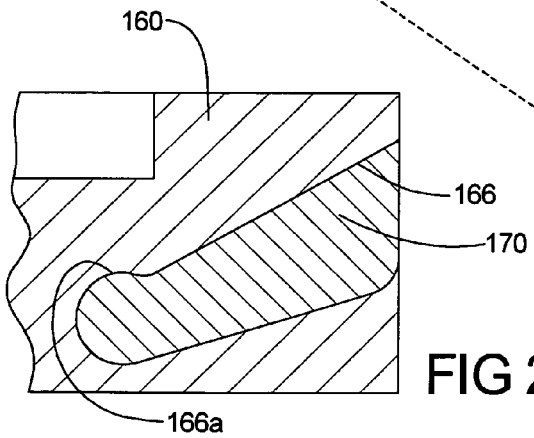
FIG 20A

MODULAR INTER-MODAL PLATFORM (MIP)

FIELD OF THE INVENTION

The present invention relates to material handling equipment, and more particularly to a platform system capable of interfacing with a wide variety of material handling equipment and cargo aircraft.

BACKGROUND OF THE INVENTION

The United States Department of Defense and, in particular, the United States Army, have recently identified a need in the handling and transporting of logistics from location to location. Specifically, the United States Army has indicated that it is in need of a material handling system that would be capable of supporting objects and materials that can be easily and conveniently transported via air, sea, rail, and road without requiring extensive support equipment or modification of the transport vehicle. In other words, the United States Army is in need of a single cargo system that is capable of interfacing with existing material handling equipment and various transport aircraft cargo systems. Additionally, the cargo system should be capable of replacing existing 463L material handling system, airdrop platforms, and Container Roll In/Out Platforms (CROPs) such that objects/materials that have been packaged for one mode of transportation (i.e. air, sea, rail, or road) that can be easily loaded for another mode of transportation without the need to repackage.

By way of background, the existing 463L material handling system generally employs pallets that are approximately 88" (224 cm)×108" (274 cm) in size. The pallets include a series of tongues extending horizontally about the periphery of the pallet. These tongues are sized to be received and retained within rails mounted on a floor of a cargo aircraft.

Often times, one type of cargo system must be secured and transported on a different cargo system for it to be used in more than one mode of transportation. For example, in order for CROPs to be loaded onto military transport aircraft, such as the C-17 and the C-130, they must first be loaded on a series of 463L pallets. The CROPs include a complexly shaped underside having numerous support members therealong, which prevent rolling of the CROPs along the aircraft cargo roller system. Therefore, in order for CROPs, or for that matter any flatrack or ISO container, to be transported via aircraft, each CROP must be loaded onto three standard 463L pallets. To this end, these three 463L pallets are first coupled to each other in a "married" configuration. Next, a large crane is required to lift the CROP onto the "married" 463L pallets. The load must then be secured to the 463L pallets with restraint straps or chains. Finally, material handling equipment, such as a K-loader, is used to transport the entire assembly, including the "married" 463L pallets and CROP, and load it onto the loading ramp of the aircraft where it is then moved into the cargo area. This procedure is necessary because the CROP cannot be rolled directly on the roller assemblies of the aircraft because of its complexly shaped lower surface.

In order for CROPs, flatracks, or ISO containers to be loaded onto the "married" 463L pallets, heavy equipment must be available at the loading and unloading site to lift such heavy cargo onto and off the 463L pallets. Traditionally, a crane and a K-loader are airlifted to the areas where the aircraft is to be loaded and unloaded, which increases the complexity of the operation.

The use of "married" 463L pallets further limits how the cargo is to be unloaded. That is, the "married" 463L pallets are unable to withstand the forces generated during a "combat offload," where the cargo is permitted to simply roll off the loading ramp of the aircraft while the aircraft is moving along a runway, taxiway, or parking ramp immediately after landing. Since combat offloads are prohibited when employing a married pallet system, the delivery of CROPs is limited to only those locations where a large crane and K-loader are available. This eliminates the possibility of off-loading cargo at generally small, austere airfields where such heavy material handling equipment is not available. Therefore, material handling equipment such as the crane and the K-loader must be flown ahead of time on a separate aircraft to the location where the aircraft carrying the CROPs is to be offloaded. On occasion, as many as three flights may be needed to deliver one CROP to an austere airfield (i.e., one flight to transport a K-loader, one flight to transport a crane, and one flight to transport the CROP). As can be readily appreciated, this significantly complicates and adversely affects the deployment of materials and equipment, as well as adding significant cost to the material transporting operation.

Additionally, conventional pallet systems limit the carrying capacity of the C-17 in that they permit only three CROPs to be carried down the center of the aircraft on the 463L interface pallets, which are secured in the 108" (274 cm) air drop rail system (ADS).

Accordingly, there exists a need in the relevant art to provide a platform system that is loaded at depots and remains secured to the platform until it reaches its customer in a forward area. In other words, it would be desirable to have a platform system that is truly inter-modal with a smooth lower surface to roll onto an aircraft roller conveyor, as well as rail extensions able to interface with truck loading systems. The platform system should also fit snugly inside of a standard ISO container, at about 90 inches (229 cm) in width, and interface with a rail system found on most transport aircraft, equipped with either 88 (224 cm) or 108 inches (274 cm).

SUMMARY OF THE INVENTION

According to various preferred embodiments of the present invention, a single modular transportation platform is provided. The platform is capable of interfacing with standardized ISO containers, PLS truck-and-trailer systems, and a cargo aircraft's 463L rail and pallet locking system. The platform provides a system that eliminates the need for a married pallet system to be used in the process of loading and supporting CROP type cargo loads being transported on a cargo aircraft. The platform can be positioned on the roller assembly of a loading ramp of a cargo aircraft, such as a C-17, so as to facilitate loading and unloading from the aircraft by a PLS Vehicle without the need for large cranes. The platform also permits combat offloads to be performed.

Further areas of applicability of the present invention will become apparent from the detailed description provided hereinafter. It should be understood that the detailed description and specific examples, while indicating various preferred embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 20 is a perspective view of a bottom portion of the bale arm assembly;

FIG. 20A is a perspective view of a receiving slot of a bale track; and,

DETAILED DESCRIPTION OF THE PREFERRED EMBODIMENTS

The following description of the preferred embodiment is merely exemplary in nature and is in no way intended to limit the invention, its application, or uses.

Figure 1:
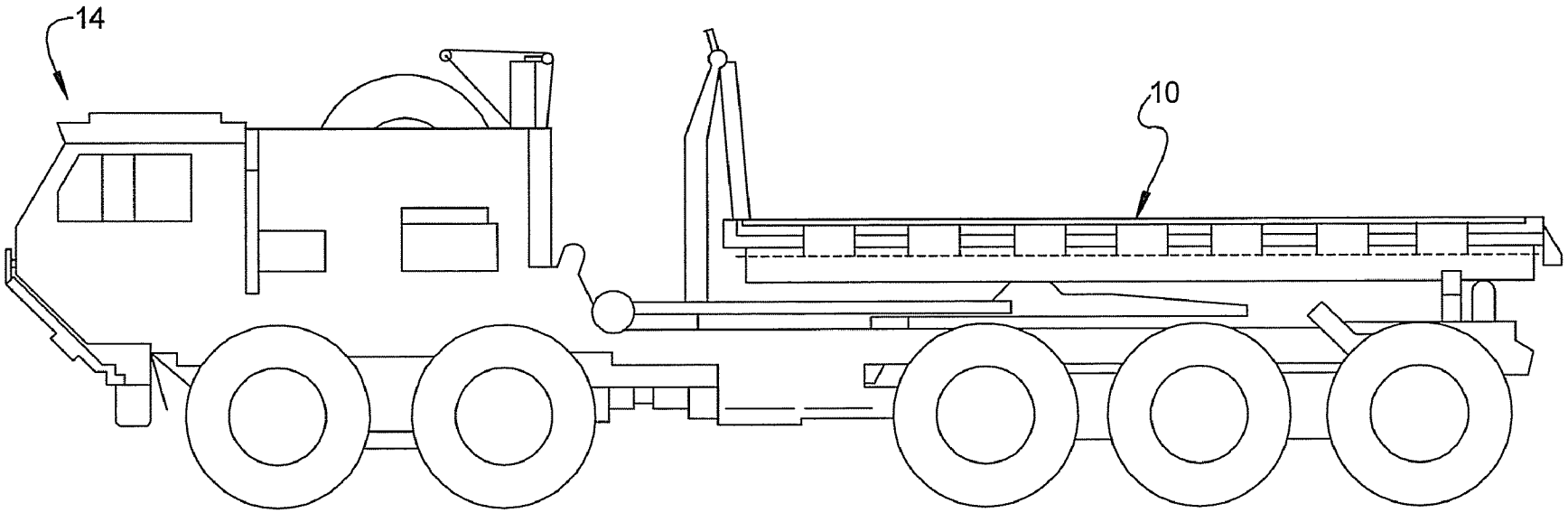
FIG. 1 is an environmental view illustrating a modular inter-modal platform (MIP) according to a preferred embodiment of the present invention loaded on a pallet load system (PLS) equipped vehicle.
Figure 2:
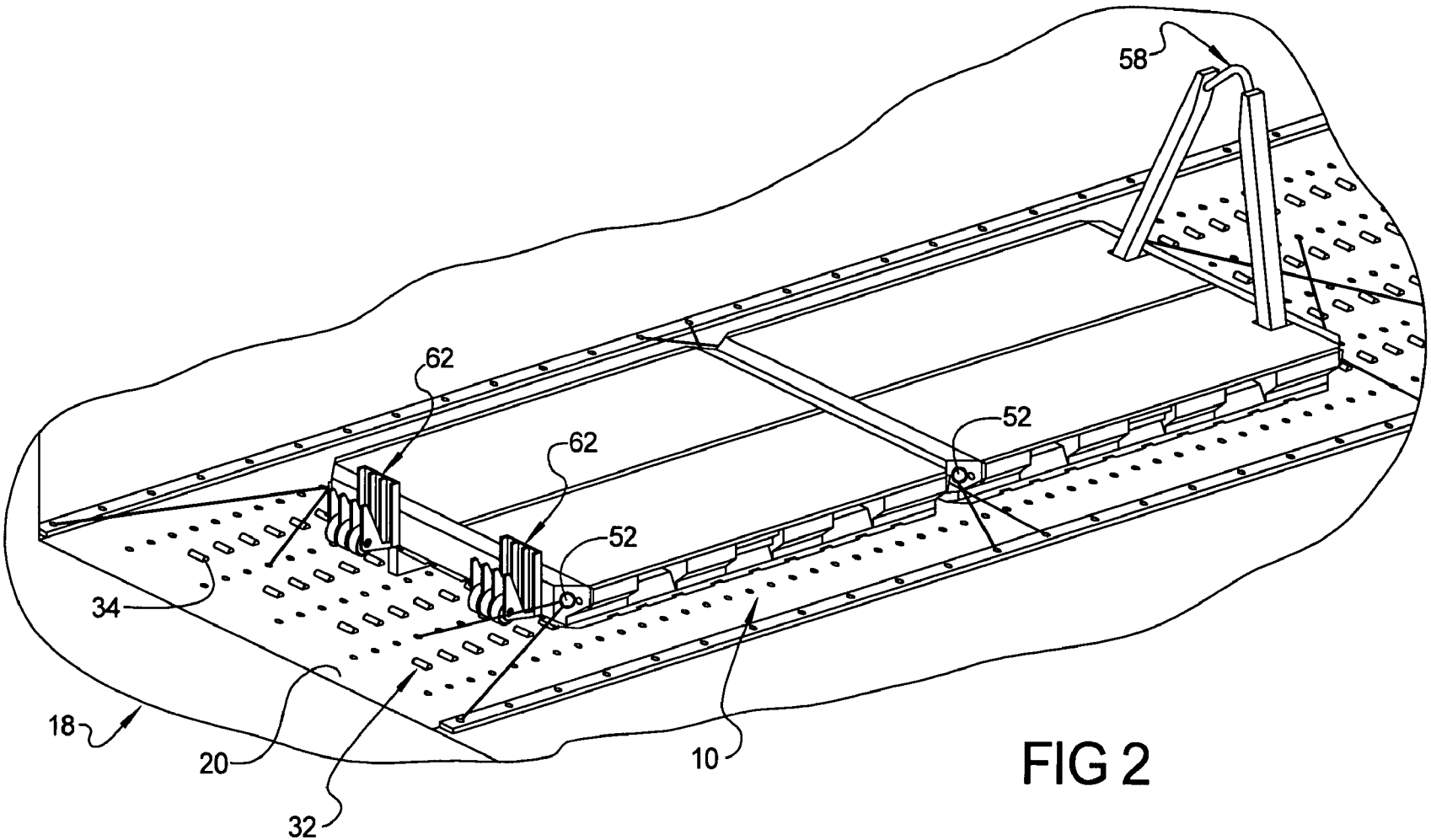
FIG. 2 is a perspective view illustrating the MIP being tied down in a 108 inch rail system of a cargo aircraft without extending a pair of extendable rails into the 108 inch rail system.

Referring to the figures, a Modular Inter-modal Platform (MIP) 10, generally referred to as the "MIP", is illustrated in accordance with a preferred embodiment of the present invention. As best seen in FIGS. 1-2, the MIP 10 is illustrated for use in concert with an aircraft 12 and an optional loading vehicle 14. The aircraft 12 is preferably a cargo type aircraft, such as a Boeing C-17, having a fuselage 16 and a cargo compartment 18 located within the fuselage 16. The cargo compartment 18 includes a deck 20 extending generally throughout the cargo compartment 18 and an actuatable cargo ramp system 22. The cargo ramp system 22 is positionable in a fully closed position, a fully opened position, and various intermediate positions between the fully closed and fully opened positions. Additionally, the cargo ramp system 22 may include an upper cargo door 24 and a lower cargo door 26. In the fully closed position, the upper cargo door 24 and the lower cargo door 26 are sealed and locked against the fuselage 16 of the aircraft 12 to form a generally smooth aerodynamic surface. In the fully opened position, the upper cargo door 24 pivots about an upper hinge member (not shown) into a generally horizontal position within the fuselage 16. The lower cargo door 26 pivots about a lower hinge member 30 into a generally extended position.

As best seen in FIG. 2, the aircraft 12 further includes a conventional cargo roller system 32 disposed within the cargo compartment 18. The cargo roller system 32 includes a plurality of rollers 34 pivotally journalled to a track (not shown). The track is typically coupled to the deck 20 of the aircraft 12 in a longitudinal direction to support cargo pallets thereon. The conventional cargo pallets typically are rolled over the plurality of rollers 34 and into position for transport. However, it should be appreciated that the MIP 10 is not limited to use with only one specific cargo roller system, but can be used with many conventional roller systems.

The MIP 10 is designed to maintain all of the existing capabilities of conventional CROPs, which includes interfacing with existing containers and vehicles. However, the MIP 10 further includes the ability to interface with all transport aircraft roller systems, such as, but not limited to, the C-5, C-17, C-130, and C-141, and C-17 type rail systems. The MIP 10 may be employed in air drop deliveries as an individual pallet, or two MIPs 10 may be linked as a large platform. Whether used individually or linked together, the MIP 10 is retrievable from the drop zone using any load handling system (LHS) equipped vehicle, thereby eliminating the need to manually unload air dropped platforms while at the drop zone. The MIP 10 enables the seamless interface between all modes of cargo transportation, including, but not limited to, the Army Palletized Load System (PLS), the HEMMT Load Handling System (LHS), the ISO container system, transport aircraft, and the Fast Sealift Theater Support High Speed Vessel (HSV) system.

Figure 3:
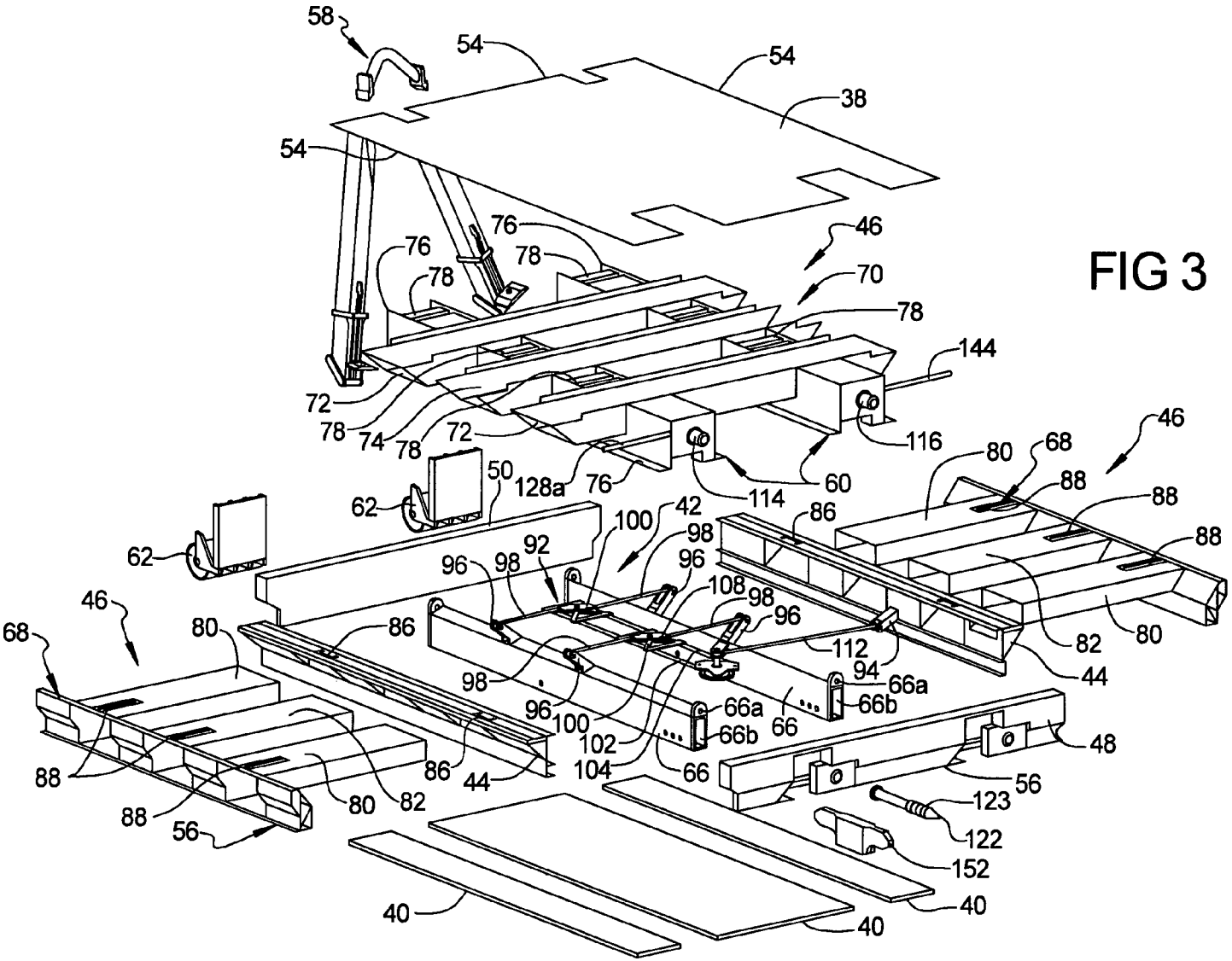
FIG. 3 is an exploded perspective view illustrating the components of the MIP.
Figure 4:
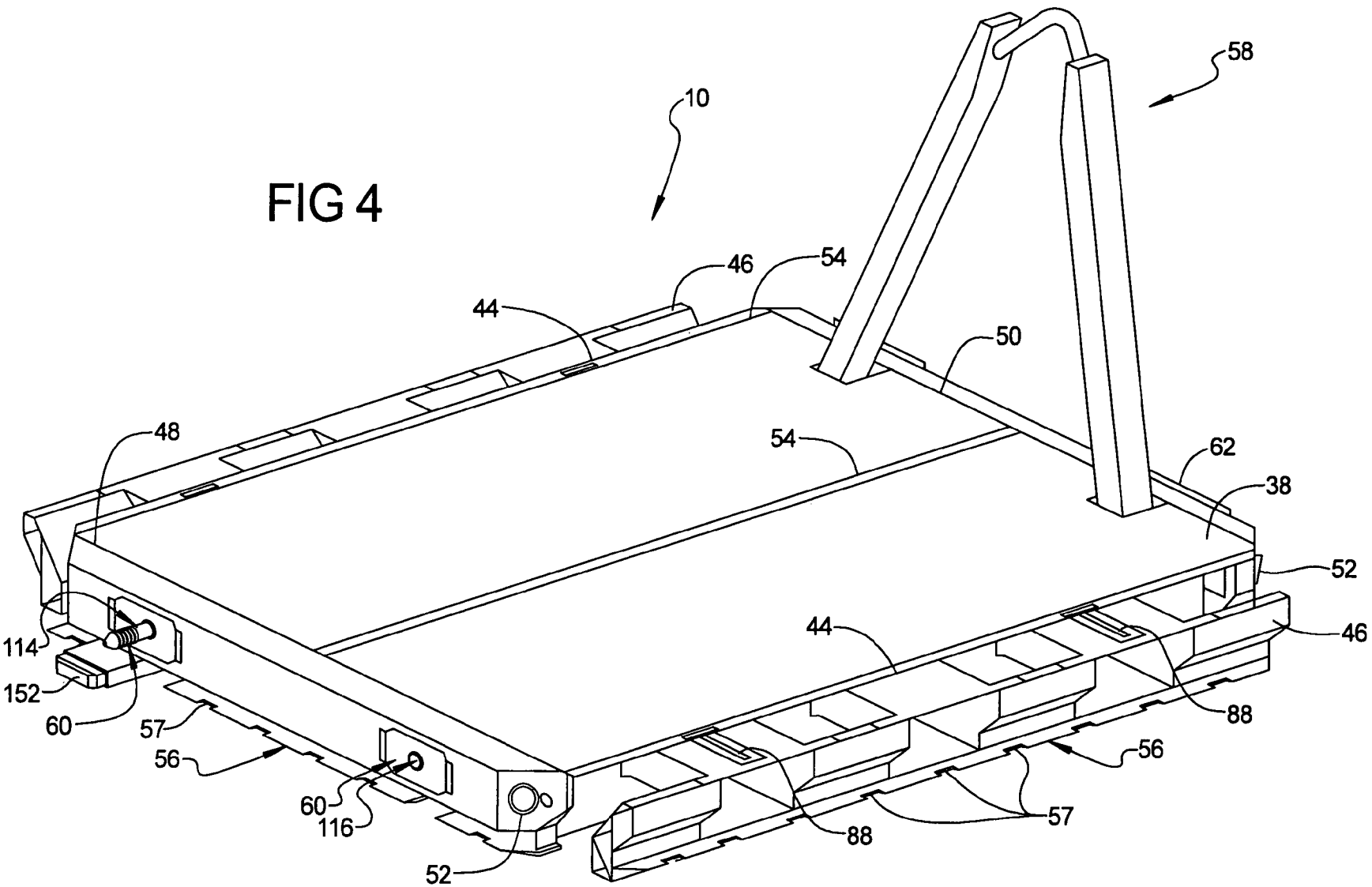
FIG. 4 is a perspective view illustrating the MIP with an extendable rail assembly in an extended position.
Figure 5:
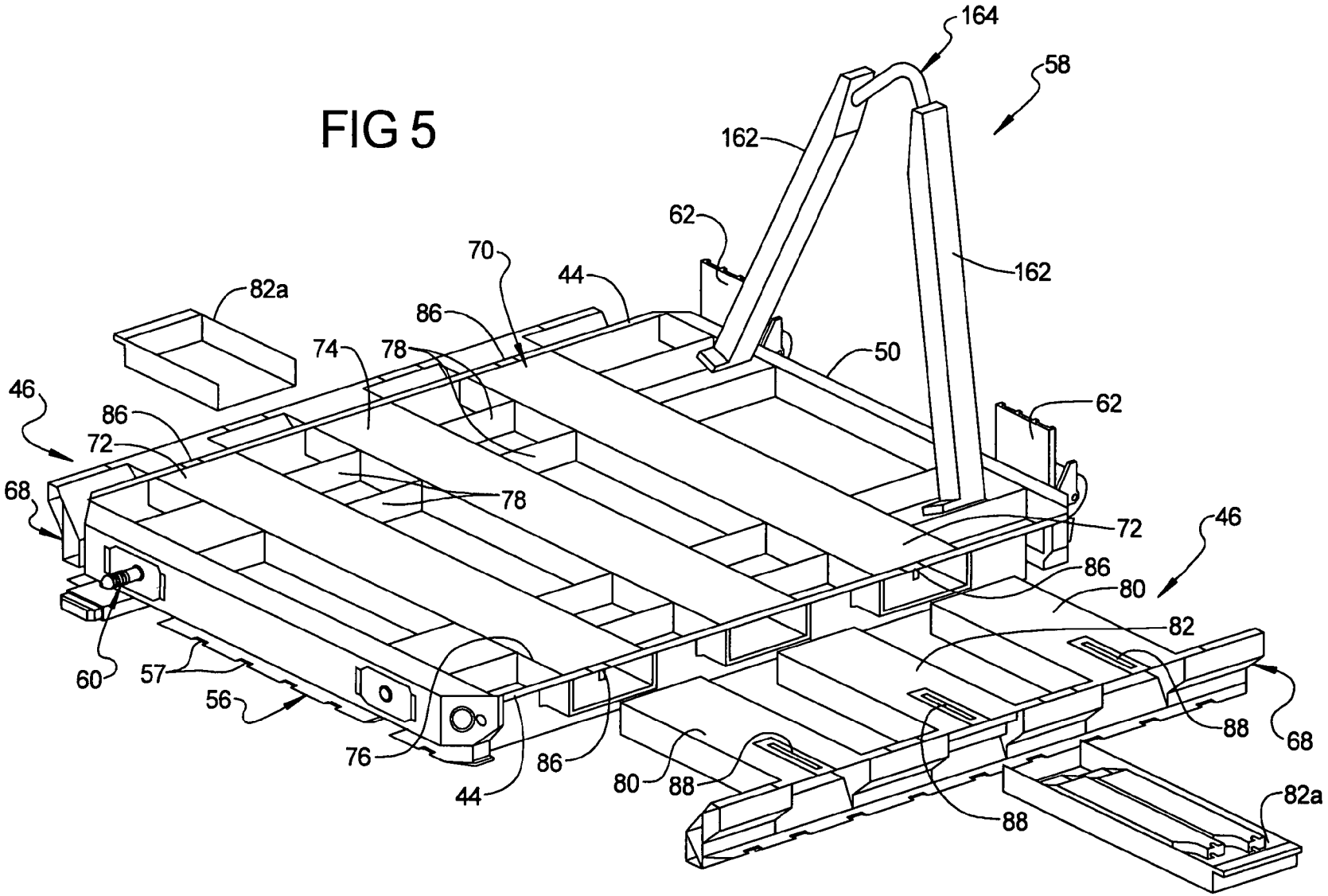
FIG. 5 is an exploded perspective view illustrating the components of the MIP.

Turning now to FIGS. 3-5, the MIP 10 will now be described in detail. The MIP 10 preferably includes an upper surface 38, a lower surface 40, a drop-down rail assembly 42, a pair of longitudinal side members 44, an extendable rail assembly 46, a mating end 48, a non-mating end 50, a plurality of heavy lift rings 52 (FIG. 4), a plurality of restraints tracks 54 (FIG. 4), a cargo system compatible edge structure 56 (FIGS. 4 and 5), a removable bale arm assembly 58, a pallet locking mechanism 60, and a plurality of removable adjustable wheel assemblies 62.

As can be appreciated in FIG. 4, the upper surface 38 is generally planar in construction and comprises a width and a length, wherein the length is substantially longer than the width. The upper surface 38 includes the plurality of restraint tracks 54. The plurality of restraint tracks 54 help to restrain cargo on the MIP 10 and to prevent cargo movement about the MIP 10. At least one restraint track 54 may be positioned on the upper surface 38 near each one of the pair of longitudinal sides 44. Additionally, at least two of the plurality of restraint tracks 54 maybe placed at about a middle of the upper surface 38 along the length of the upper surface 38.

Figure 10:
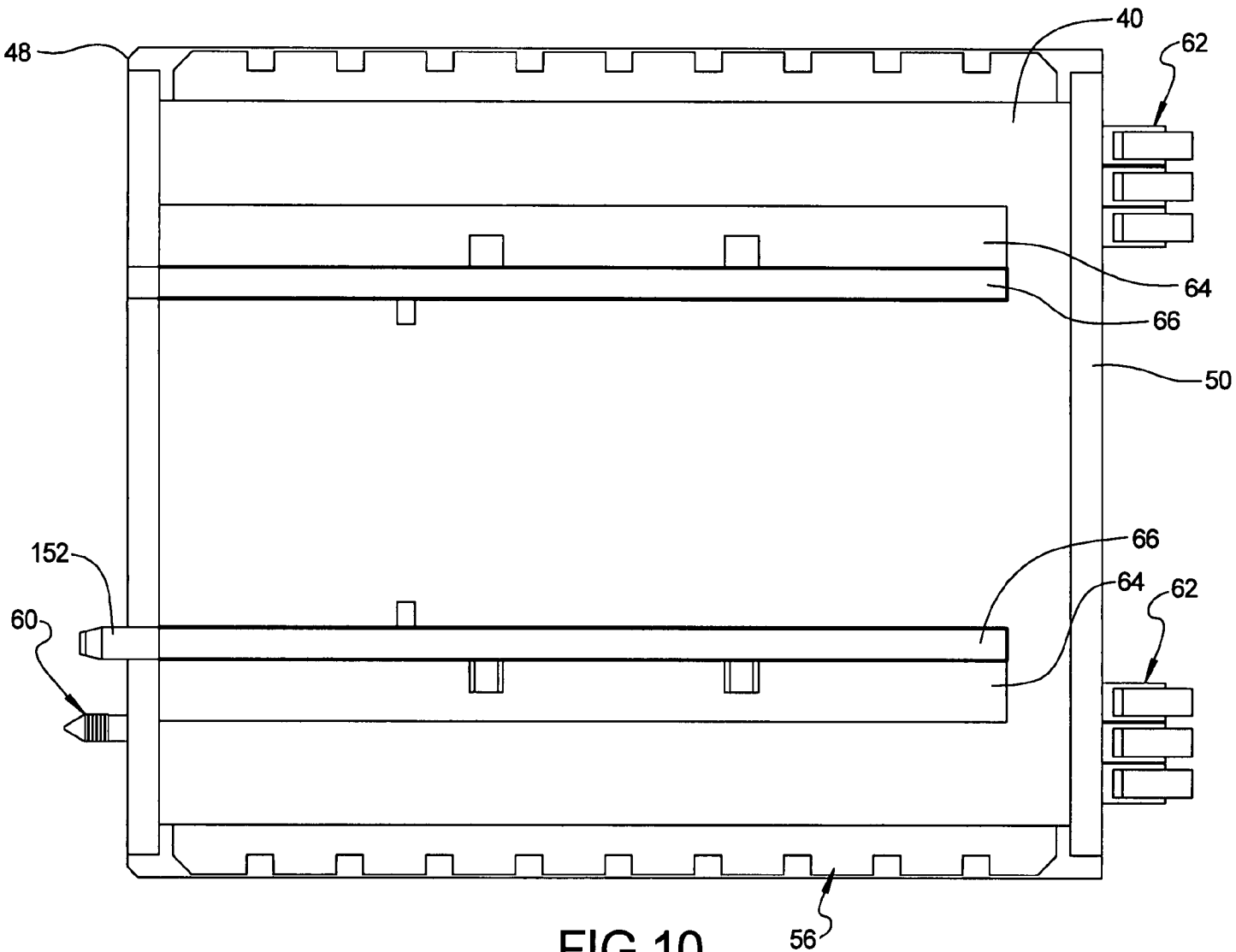
FIG. 10 is a bottom view illustrating the MIP having its pair of drop-down rails in the extended position.

Referring to FIGS. 3 and 10-12, the lower surface 40 is generally planar in construction, but for those features that will be described in detail below. The lower surface 40 comprises a width and a length, wherein the width and length corresponds to the width and length of the upper surface 38. The lower surface 40 further includes a plurality of recesses 64 (FIG. 10). Each recess 64 includes a depth, length, and width that is complementary to a depth, a length, and a width, respective to each drop-down rail 66 of the drop-down rail assembly 42.

As best seen in FIGS. 4-5, the cargo system compatible edge structure 56 extends around the width and the length of the lower surface 40 on the mating end 48 and the non-mating end 50, as well as along a length of each extendable rail 68 of the extendable rail assembly 46. Preferably, the edge structure 56 is approximately 88" (234 cm) wide and 108" (274 cm) long (as seen in FIG. 4) so as to be immediately compatible with cargo rail systems used in transport vehicles, such as the C-17 and C-130 aircraft, Theater Support High Speed Vessels (HSVs), and K-loaders. As best seen in FIG. 4, edge structure 56 further includes a plurality of notches 57 formed therein, so as to lockingly engage pallet locks currently available on cargo transport aircraft.

Referring to FIGS. 3-5, the pair of longitudinal sides 44, the mating end 48, and the non-mating end 50 of the MIP 10 extend vertically between the upper surface 38 and lower surface 40, thereby defining an individual robust pallet or platform member. However, it should be understood that the MIP 10 may comprise any shape that is conducive to supporting and transporting cargo.

Referring to FIGS. 3 and 5, the pair of longitudinal sides 44 help form a forklift channel assembly 70 for the extendable rail assembly 46. The forklift channel assembly 70 includes a plurality of covered forklift channel slots 72, a storage channel slot 74, and a pair of housing units 76. The plurality of forklift channel slots 72 and the storage channel slot 74 are coupled to the pair of housing units 76, such that one of the plurality of forklift channel slots 72 is placed on opposite sides of the storage channel slot 74. Additionally, the plurality of forklift channel slots 72 and the storage channel slot 74 are equally spaced apart within the pair of housing units 76. The forklift channel slots 72 and the storage channel slot 74 are formed generally parallel to at least one of the upper surface 38 and the lower surface 40. The forklift channel slots 72 are sized to receive a pair of extendable rails 68. The forklift channel slots 72 and the storage channel slot 74 each extend through the MIP 10 to permit any cargo loaded thereon to be conveniently lifted with a conventional forklift without the need to tear down the loaded cargo (FIG. 5).

Coupled to the forklift channel assembly 70 is the pair of extendable rails 68 via the pair of longitudinal sides 44. The pair of extendable rails 68 extend the width of the upper surface 38 and the lower surface 40 from approximately 88" (224 cm) to approximately 108" (274 cm) (as seen in FIG. 4), so as to be immediately compatible with all 463L type rails found on all transportation aircraft including, but not limited to, cargo rail systems used in transport vehicles, such as the C-17 and C-130 aircraft, Theater Support High Speed Vessels (HSVs), K-loaders. The pair of extendable rails 68 can interface with any air cargo system of military transport aircraft, as well as meet restraint requirements without the use of a supplemental restraint, such as chains or straps. Additionally, each extendable rail 68 includes a plurality of forklift receptacles 80. The forklift receptacles 80 are sized to receive forks of a conventional forklift and fit within the forklift channel slots 72.

Referring to FIG. 5, each extendable rail 68 further includes at least one storage chamber 82 for receiving a removable storage tray 82*a*. The storage chamber 82 is positioned between the forklift receptacles 80. Additionally, the storage tray 82*a* is sized to receive at least a portion of the bale arm assembly 58 when the assembly 58 is disassembled and/or cargo components.

In an extension or retraction operation, the user utilizes a plurality of keyed implements 86 located on each of the pair of longitudinal sides 44. Each keyed implement 86 is inserted through one of the plurality of longitudinal sides 44 into a keyed track 88 located on each of the plurality of forklift receptacles 80. Each keyed implement 86 is turned to a 90 degree angle to a surface of one of the pair of longitudinal sides 44 to unlock and allow the plurality of extendable rails 68 to manually transition from a first position to a second position and to expand or reduce an overall width of the MIP 10. Once a desired width of the MIP 10 is achieved by pushing or pulling the plurality of extendable rails 68 into or out of the MIP 10, the keyed implement 86 is returned to a 0 degree or 180 degree angle relative to its associated longitudinal side 44 to lock its associated rail 68 in the desired position.

Figure 6:
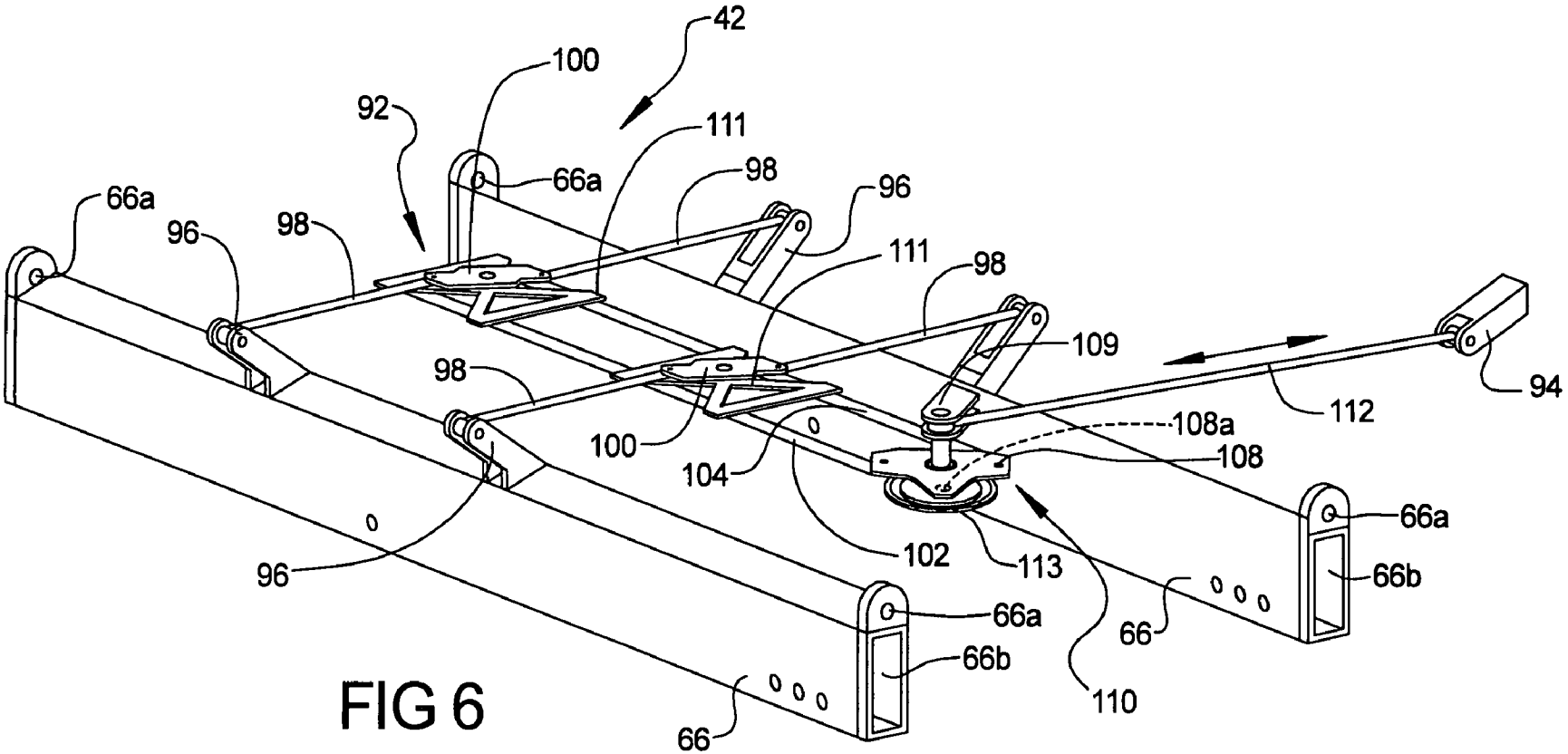
FIG. 6 is a perspective view illustrating the drop-down rail assembly of the MIP, with a pair of drop-down rails in an extended position.

Turning to FIGS. 3 and 6, the drop-down rail assembly 42 is pivotally coupled to the extendable rail assembly 46 via pivotal portions 66*a* of the pair of drop-down rails 66. The drop-down rail assembly 42 includes the pair of drop-down rails 66, a transition drive assembly 92, and an actuating device 94. The drop-down rails 66 are coupled to the transition drive assembly 92. The transition drive assembly 92 is coupled to the actuating device 94.

Figure 1A:
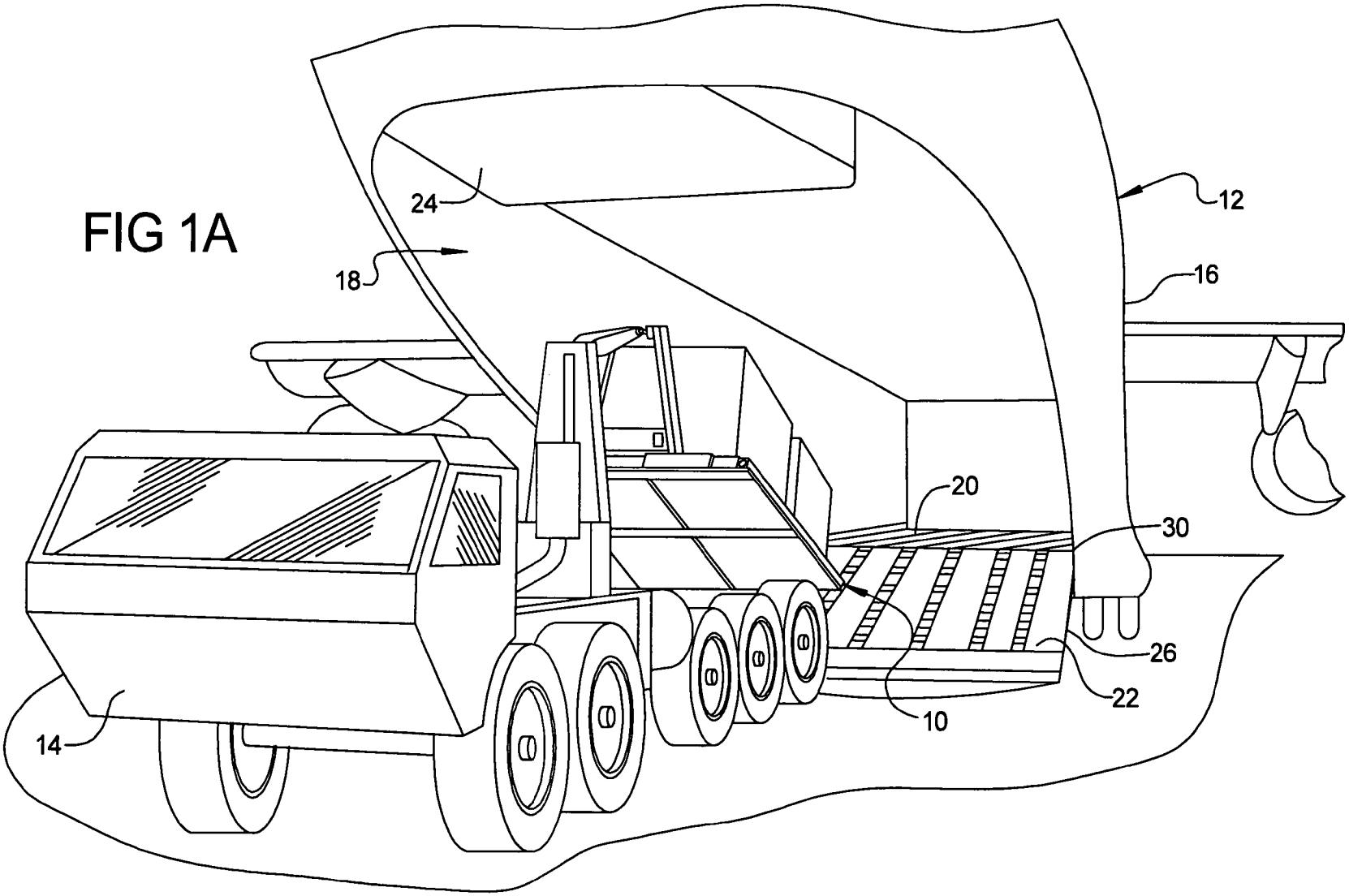
FIG. 1A is an environmental view illustrating the MIP of FIG. 1 being loaded on a cargo aircraft by the PLS equipped vehicle.
Figure 11:
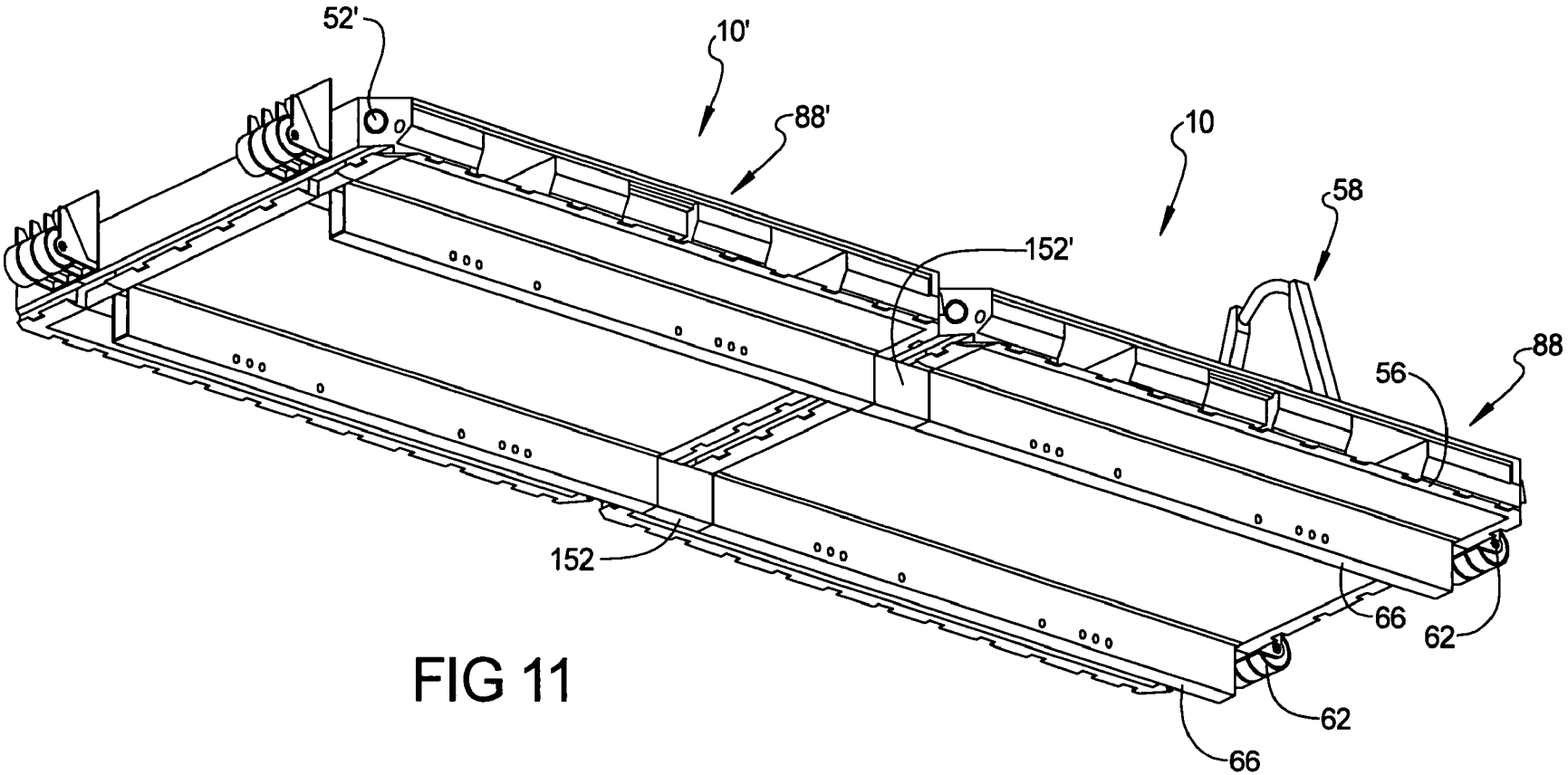
FIG. 11 is a bottom perspective view illustrating a pair of MIPs linked together.
Figure 12:
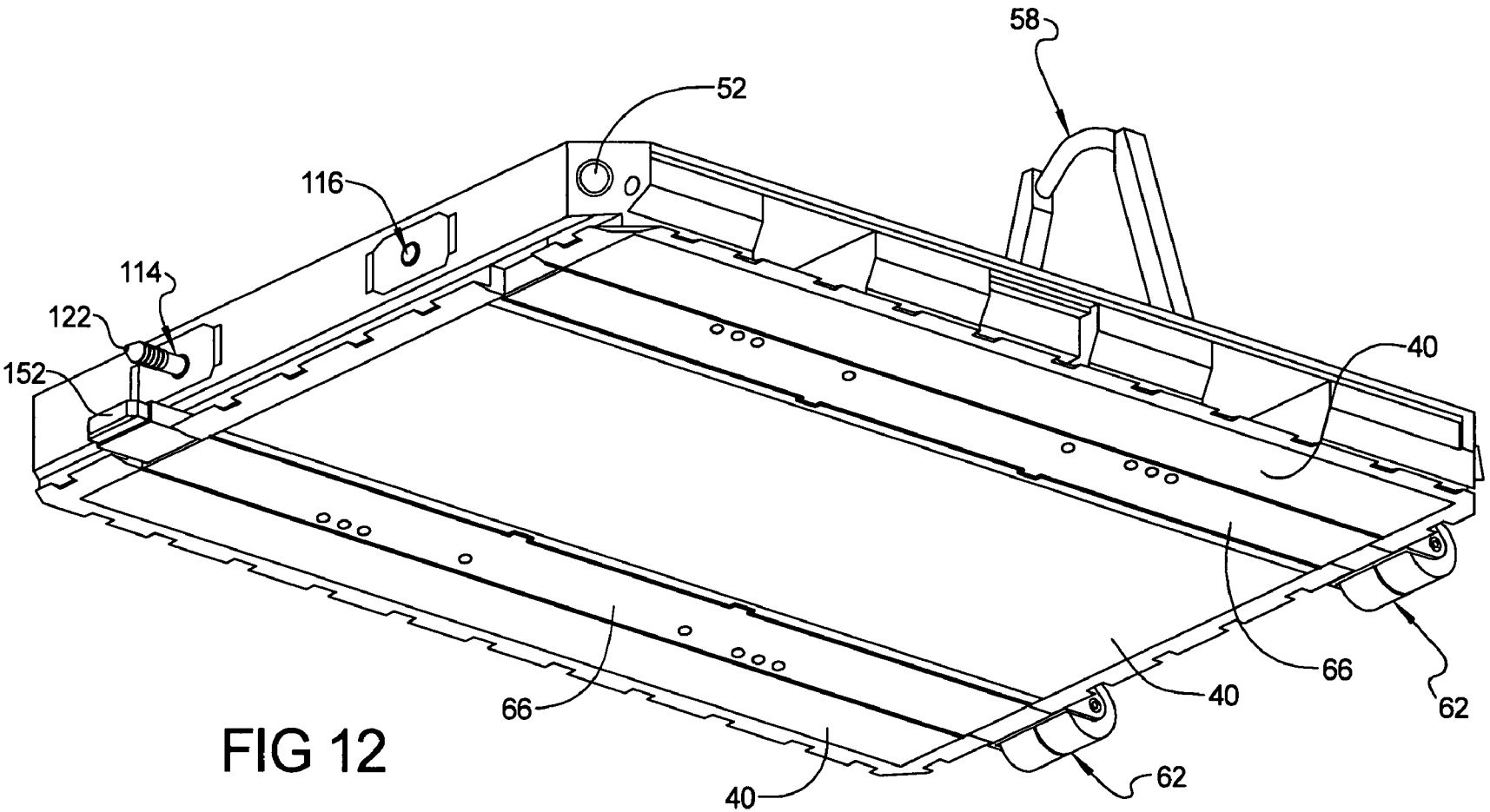
FIG. 12 is a bottom perspective view illustrating the MIP having its pair of drop-down rails in the retracted position.
Figure 13:
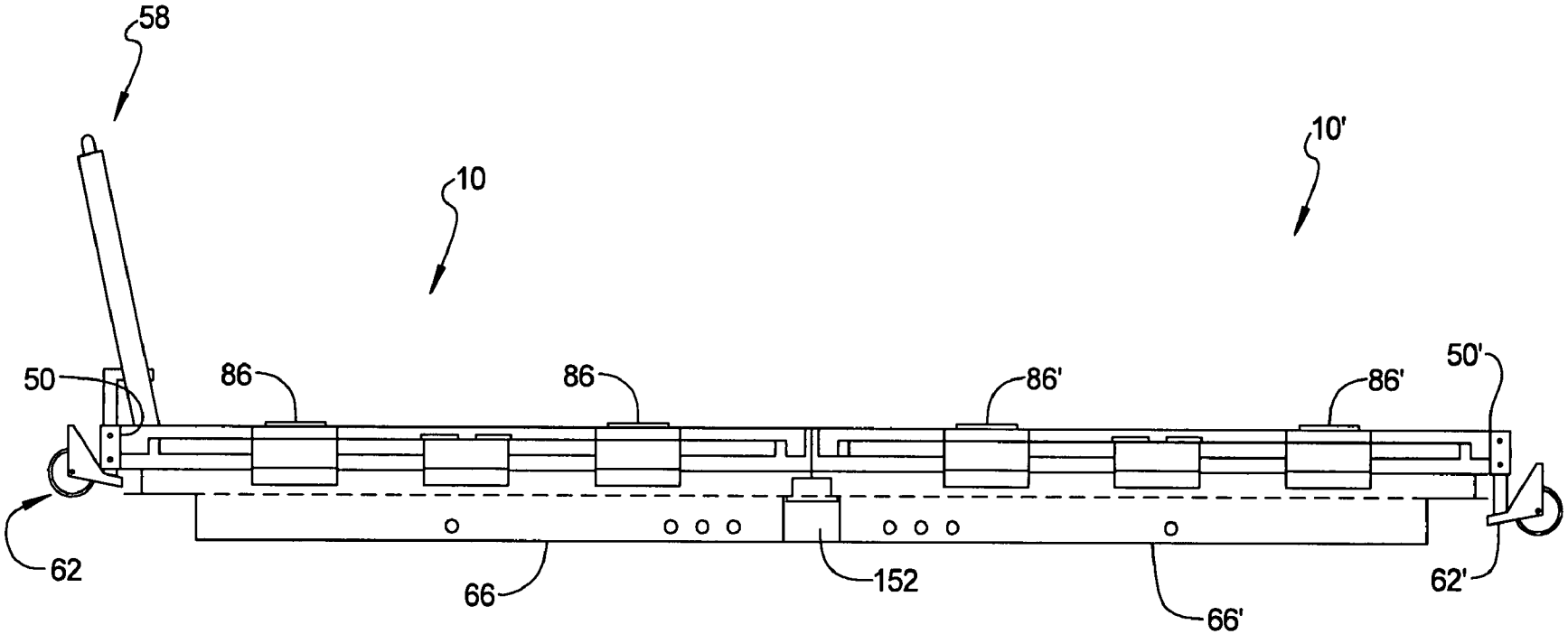
FIG. 13 is a side view illustrating a pair of MIPs linked together.

As shown in FIGS. 10-12, each drop-down rail 66 is preferably disposed longitudinally about one third the distance from each edge of the width of the lower surface 40. Additionally, each drop-down rail 66 is operable in a first mode and a second mode. Referring to FIGS. 10, 11, and 13, in the first mode, the drop-down rail assembly 42 is configured to project away from the lower surface 40 when the drop-down rails 66 are extended. As best shown in FIG. 1A, The first mode comprises a ground operation mode adaptable to align with a roller and restraint system 14*a* located on the optional loading vehicle 14, for example a PLS truck. Turning now to FIGS. 4, and 12, in the second mode, the drop-down rails 66 form a flat surface co-planar with the lower surface 40. The second mode is accomplished by stowing the pair of drop-down rails 66 into the plurality of recesses 64, such that each drop-down rail 66 is substantially flat and co-planar with the lower surface 40 to interface with the cargo roller systems on all transport aircraft, and K-loaders (FIG. 2).

Figure 6A:
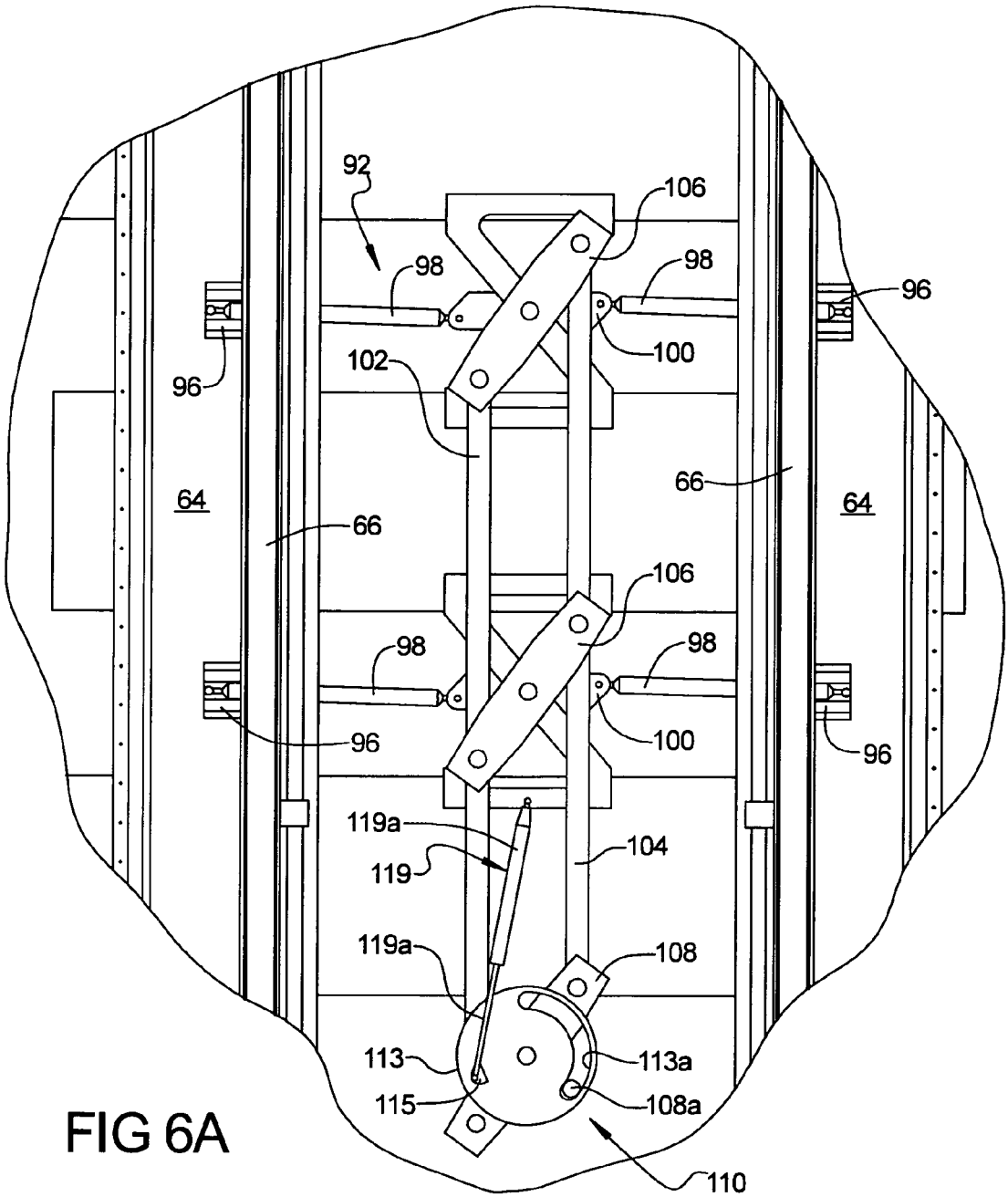
FIG. 6A is a bottom view illustrating a transition drive assembly of a drop-down rail assembly of the MIP, having the pair of drop-down rails in the extended position.

Turning to FIG. 6, the drop-down rail assembly 42 includes each drop-down rail 66 having a plurality of legs 96. Each leg 96 is pivotally coupled to one end of a positioning rod 98 of the transition drive assembly 92. The other end of each positioning rod 98 is pivotally coupled to one of a pair of pivoting arms 100. The pivoting arms 100 are positioned over a first rod 102 and a second rod 104 and coupled to an associated transition device 106 (FIG. 6A) via transition unit 111. The transition devices 106 are pivotally coupled to the first rod 102 and the second rod 104 at their opposite ends. Referring to FIGS. 6 and 6A, the first rod 102 and the second rod 104 are coupled via a plate 108 to a rotating assembly 110 with the rotating assembly having a rotating idler lever 109. The rotating idler lever 109 is coupled to a shifting rod 112. The shifting rod 112 is pivotally coupled to the actuating device 94. The actuating device 94 in turn is coupled to one of the pair of longitudinal sides 44. Additionally, one end of the idler lever 109 is pivotally coupled to a disk 113 having an arcuate channel slot 113*a*. The disk 113 abuts the plate 108 and a peg 108*a* of the plate 108 extends through the channel slot 113*a* of the disk 113. Coupled via a hinge assembly 115 to the disk 113 is a piston rod 119*a* of a linear piston and cylinder assembly 119, wherein a cylinder 119*b* of the linear piston and cylinder assembly 119 is coupled to one of the transition unit 111. The linear piston and cylinder is biased with the piston rod 119*a* extending outward.

Figure 7:
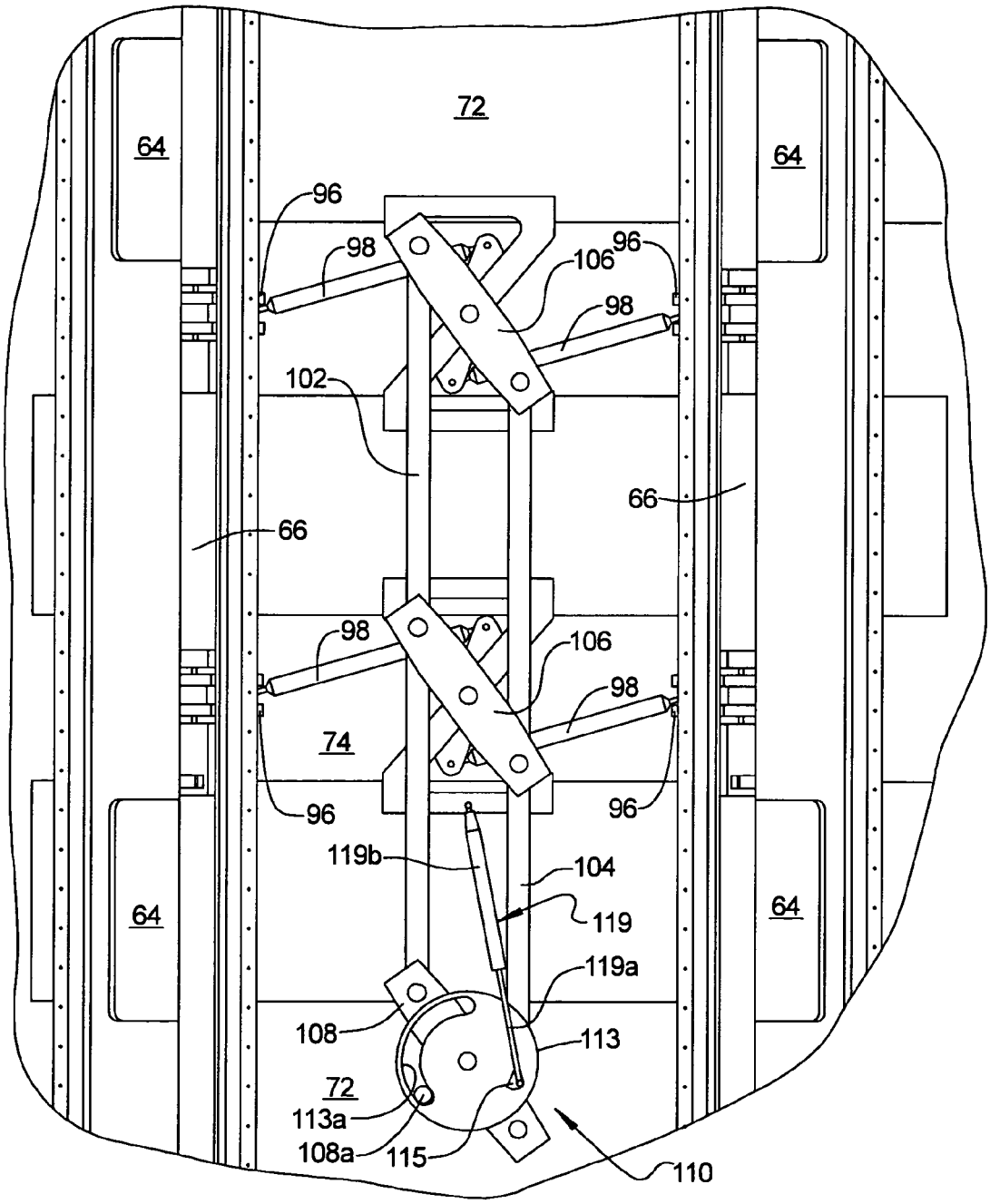
FIG. 7 is a bottom view illustrating the transition drive assembly of the drop-down rail assembly of the MIP, having the pair of drop-down rails in a retracted position.
Figure 8:
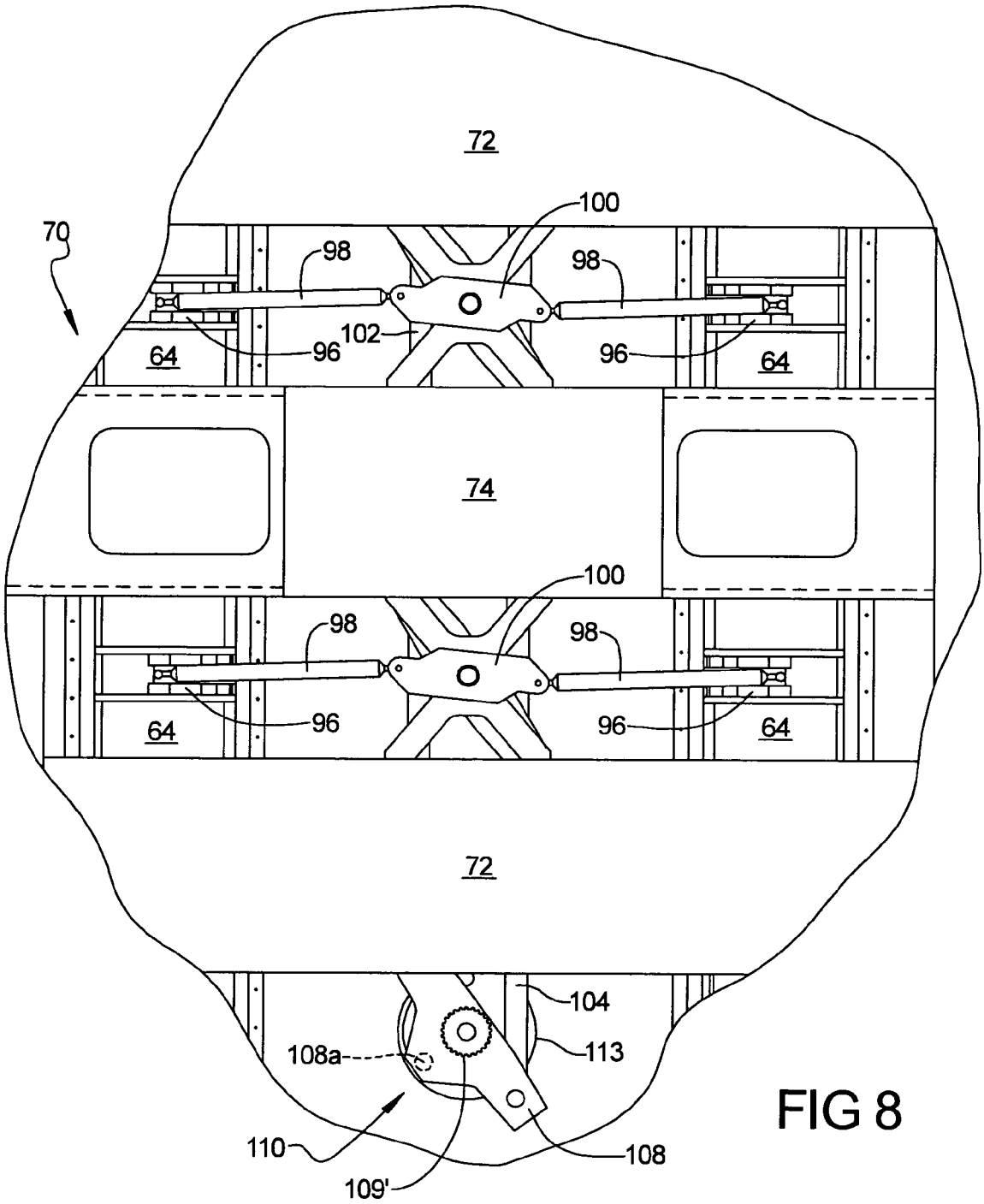
FIG. 8 is a top view illustrating the transition drive assembly of the drop-down rail assembly of the MIP, having the pair of drop-down rails in the extended position.
Figure 9:
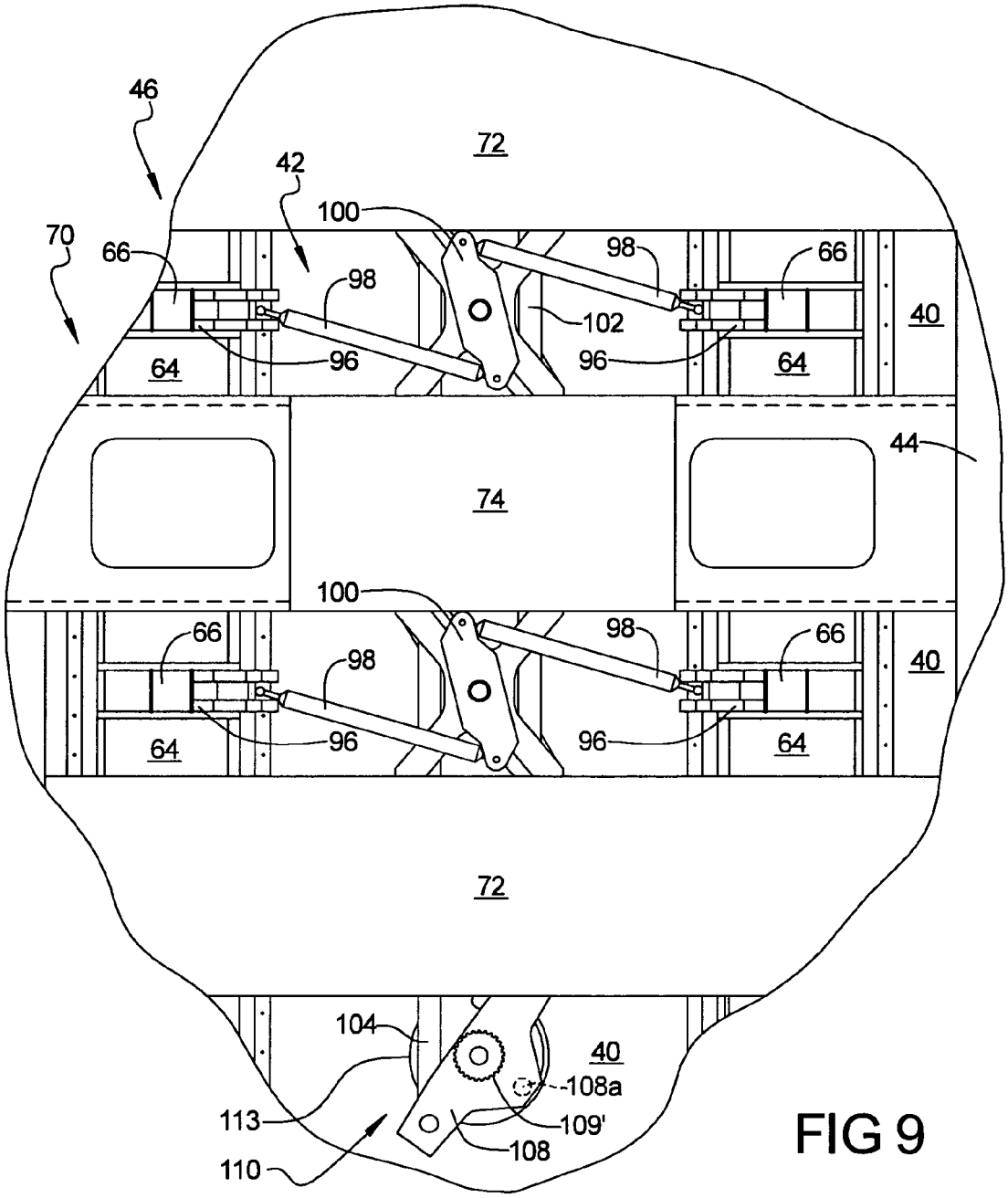
FIG. 9 is a top view illustrating the transition drive assembly of the drop-down rail assembly of the MIP, having the pair of drop-down rails in the retracted position.

In a retraction operation, a user pivots the actuating device 94 in a first direction by inserting and turning a rod-like key (not shown) in the actuating device 94. This causes the shifting rod 112 to rotate the idler lever 109. Referring to FIGS. 6-9, as the idler lever 109 is rotated, the disk 113 rotates clockwise (in the drawing of FIG. 6) such that the channel slot 113*a* (FIGS. 6A and 7) rotates clockwise until the peg 108*a* rests in a first position at a corner of the channel slot 113*a* and the piston rod 119*a* of the linear piston and cylinder assembly 119 rotates with the disk 113. As the linear piston and cylinder assembly 119 rotates, the piston rod 119*a* is pushed into the cylinder 119*b*, after which the piston rod 119*a* extends, forcing the channel slot 113*a* to continue to pull the peg 108*a* clockwise to a second position (FIG. 7). This causes the plate 108 of the rotating assembly 110 to translate the first rod 102 and the second rod 104 toward each other. As shown in FIGS. 8 and 9, this causes rotation of each transition device 106 and pivot arm 100 from a first fixed position to a second fixed position. As each pivot arm 100 rotates, each positioning rod 98 is pulled inward and each leg 96 on each of the drop-down rails is pulled down. This causes each of the drop-down rails 66 to be retracted into their respective recesses 64.

In an extension operation, the user moves the rod-like key to turn the actuating device 94 in a second direction to extend the pair of drop-down rails 66 from their retracted positions. Referring to FIG. 6A, the actuating device 94 pulls the shifting rod 112 in the opposite direction, causing the disk 113 to pull the peg 108*a* of the plate 108 in the counter clockwise direction. This rotates the linear piston and cylinder assembly 119, which pushes the piston rod 119*a* into the cylinder 119*b* creating a compressed force. As the piston rod 119*a* extends, the disk 113 continues to pull the peg 108*a* in the counter clockwise direction, which in turn causes the plate 108 to translate the first rod 102 and the second rod 104 away from each other (FIGS. 6A and 7). As the first rod 102 and the second rod 104 translate, each transition device 106 and pivot arm 100 rotate from the second fixed position to the first fixed position, thus pushing each positioning rod 98 outward (FIGS. 8 and 9). This pushing action in turn causes each leg 96 to pivot its associated drop-down rail 66 into an extended position.

Referring to FIGS. 8 and 9, alternatively, the actuating device 94 may include a first sprocket device (not shown) to replace the actuating device 94 and a second sprocket device 109' to replace the idler lever 109. Additionally, instead of the shifting rod 112, a chain (not shown) can be used to couple the first sprocket device to the second sprocket device 109'. As the user turns the first sprocket, the first sprocket turns clockwise driving the chain to turn the second sprocket device 109' clockwise, which in turn rotates the disk 113 clockwise. The remaining elements and functions of the transition drive assembly 92 would otherwise remain the same.

As best seen in FIGS. 2, 4, 5, 11, and 12, the lift rings 52 at the comers of the MIP 10 are fixedly coupled to a corner section 90 vertically disposed between either the mating end 48 or the non-mating end 50 and longitudinal sides 44. This permits the lifting of a loaded MIP 10 using a crane, helicopter, or similar machinery and/or tying down of the MIP 10 within cargo compartment 18.

Figure 14:
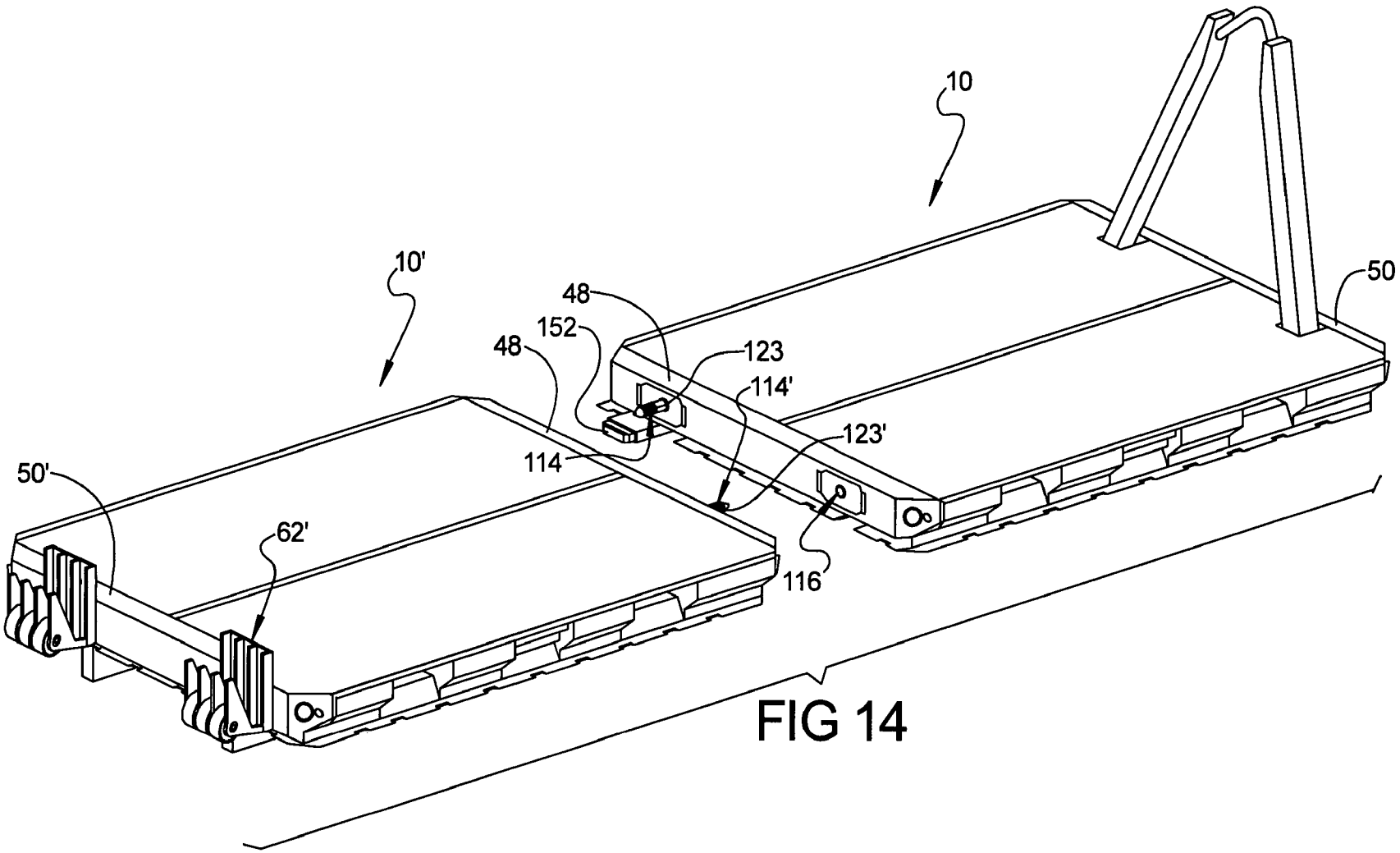
FIG. 14 is a perspective view illustrating a pair of MIPs having locking mechanisms.
Figure 17:
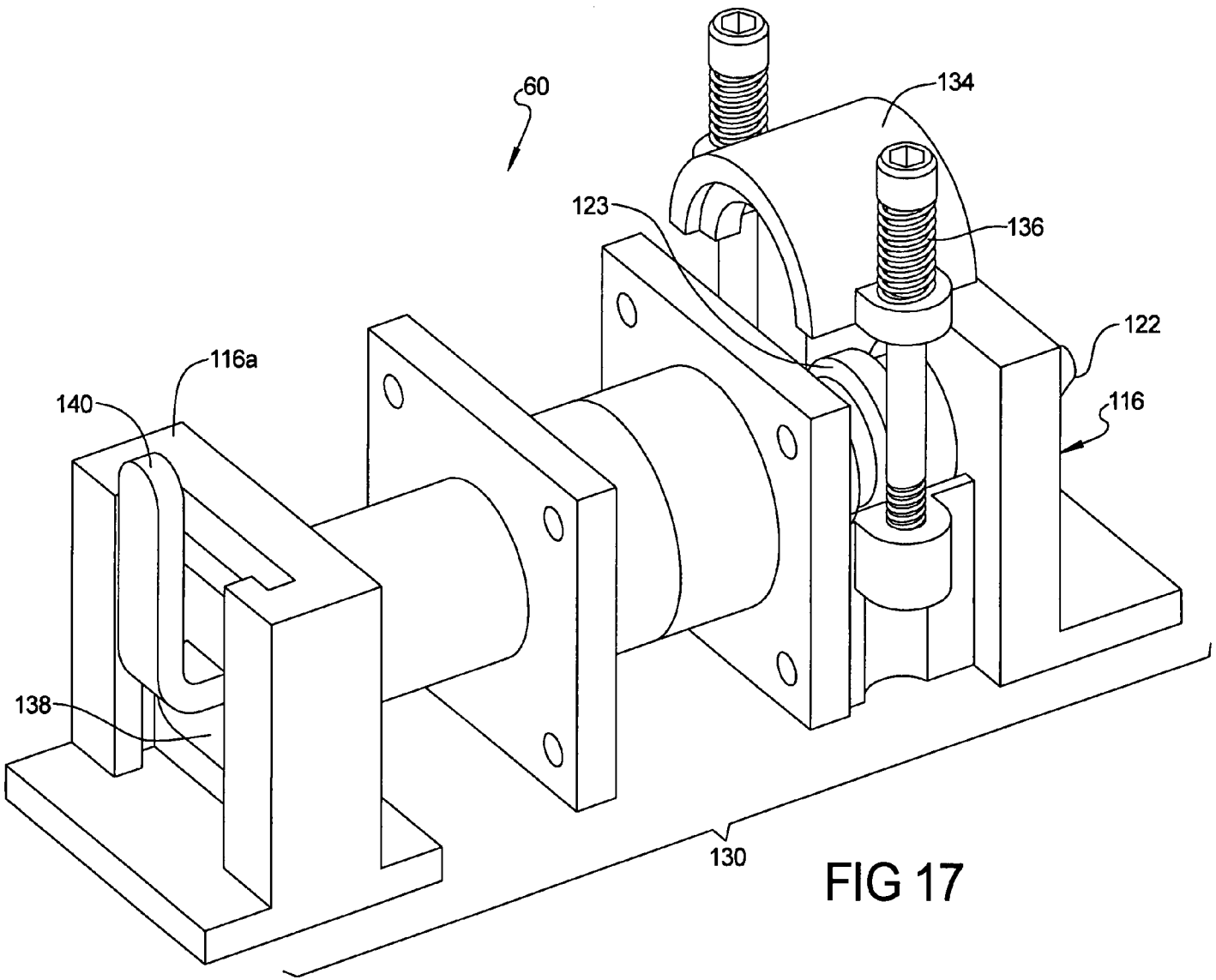
FIG. 17 is a perspective view of a pair of locking mechanisms used to link a pair of MIPs together to form a single, elongated MIP.
Figure 17A:
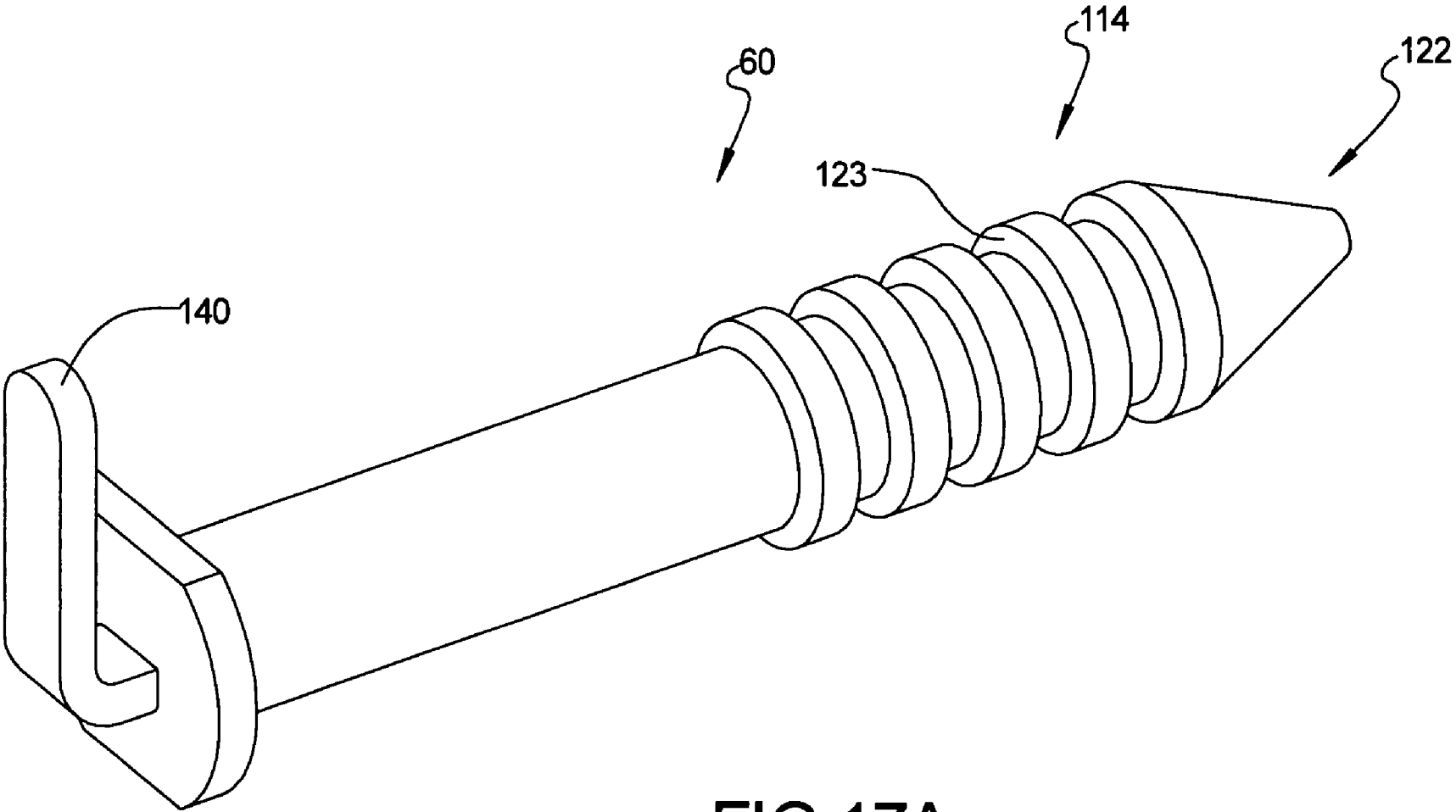
FIG. 17A is a perspective view of a pin of the male connector assembly of the pair of locking mechanisms.

Turning now to FIGS. 3-5 and 16-17A, the MIP 10 also employs the pallet locking mechanism 60. The pallet locking mechanism 60 is operable to link multiple MIPs 10 together (FIG. 14). The pallet locking mechanism 60 is coupled to the mating end 48 of the MIP 10. As seen in FIGS. 14, 17 and 17A, the pallet locking mechanism 60 includes a male connector assembly 114 (FIG. 17A) and a female connector assembly 116 (FIG. 17) that cooperates to mate with a second female connector assembly 116' and a second male connector assembly 114' of an identical MIP 10' to define a single, substantially co-planar pallet (FIG. 14). The pallet locking mechanism 60 couples the MIP 10 and the identical MIP 10' together to form a rigid platform transportable by the loading vehicle 14 (FIGS. 1-2).

Referring to FIGS. 3 and 17A, the male connector assembly 114 includes a pin 122, a cranking device (not shown), and a pin actuator (not shown). The pin actuator having a rod 128*a* is coupled to the cranking device. The cranking device is in turn coupled to the pin 122.

As shown in FIG. 17, the female connector assembly 116 includes a pin receptacle 130. The pin receptacle 130 includes an annular, multi-toothed gate 132 at one end 116*b* and an aperture 138 at another end 116*a*. The annular multi-toothed gate 132 includes a collet 134 coupled via a pair of springs 136.

In operation, the user actuates a latch (not shown) to unlock the pin 122 and manually extends the pin 122, located within the male connector assembly 114, from a first or stowaway position to a second or mating position. By actuating the latch a second time, the user locks the pin 122 in the second position.

After the pin 122 is extended, the MIP 10 and the identical MIP 10' may be aligned and pushed together for a gross alignment. Any final guiding or aligning of the MIP 10 and the identical MIP 10' is accomplished via the pin 122 of the MIP 10 and an identical pin 122' of the identical MIP 10'. As shown in FIG. 14, Tapers 123, 123' of the pin 122 and the identical pin 122' along with respective pin receptacles 130, 130' are sized to allow forgiveness when positioned to close up any gaps when the MIP 10 and the identical MIP 10' are mated together.

Once the pins 122, 122' are fully inserted, the pin 122 and the identical pin 122' automatically engage the female connector assembly 116 and an identical female connector assembly 116', respectively. In the following discussion, although the coupling of two pallet locking mechanisms 60 is accomplished, only one portion of the mating operation for the pallet locking mechanism 60 will be further discussed. As the pin 122 enters its respective multi-toothed gate 132', the pin 122 will push the collet 134 in an upward direction against the spring 136. The force of the spring 136 will then press the collet 134 in a downward direction and return the collet 134 to its original position. Once the pin 122 and it respective pin receptacle 130' are engaged, a small gap (typically about ¼, 6.35 mm) between the MIP 10 and the identical MIP 10' will exist. This gap is closed by inserting a rod-like device (not shown) into the pin actuator 128 to turn a bevel gear (not shown). The bevel gear cranks a handle 140 of the pin 122 clockwise, wherein the pin 122 is retracted in a horizontal direction to tighten and close the gap between the MIP 10 and the identical MIP 10'(FIGS. 17 and 17A).

However, as it should be understood, the pallet locking mechanism 60 enables the MIP 10 and 10' to be easily coupled, but equally importantly, to be easily separated to facilitate the handling of the MIP 10 in smaller, lighter segments.

As shown in FIGS. 4-5 and 10-14, The MIP 10 includes a rail aligner 152, such as a drop-down rail plug 152, is provided. The drop-down rail plug 152 is temporally coupled to one of the pair of drop-down rails 66 (FIG. 4). As shown in FIGS. 3, 4 and 11-13, the drop-down rail plug 152 is manually inserted into an aperture 66*b* of one of the drop-down rails 66. Referring to FIG. 11, once inserted into a pair of drop-down rails, the drop-down rail plug 152 aligns and fills a gap between one of the pair of drop-down rails 66 of the MIP 10 and an opposing drop-down rail 66' of MIP 10'. In the same manner, a second drop-down rail plug 152' of the identical MIP 10' is used align and fill another gap between any remaining unplugged one of the pair of drop-down rails 66 of the MIP 10 and any remaining unplugged opposing drop-down rail 66' of MIP 10'.

The MIP 10 is preferably made of aluminum and is therefore sufficiently light to enable it to be lifted and transported by light cargo handling equipment. However, it should be appreciated that the MIP 10 may be made of any material that provides the necessary physical characteristics to achieve the preferred loading capability, corrosion resistance, durability, etc.

Figure 18:
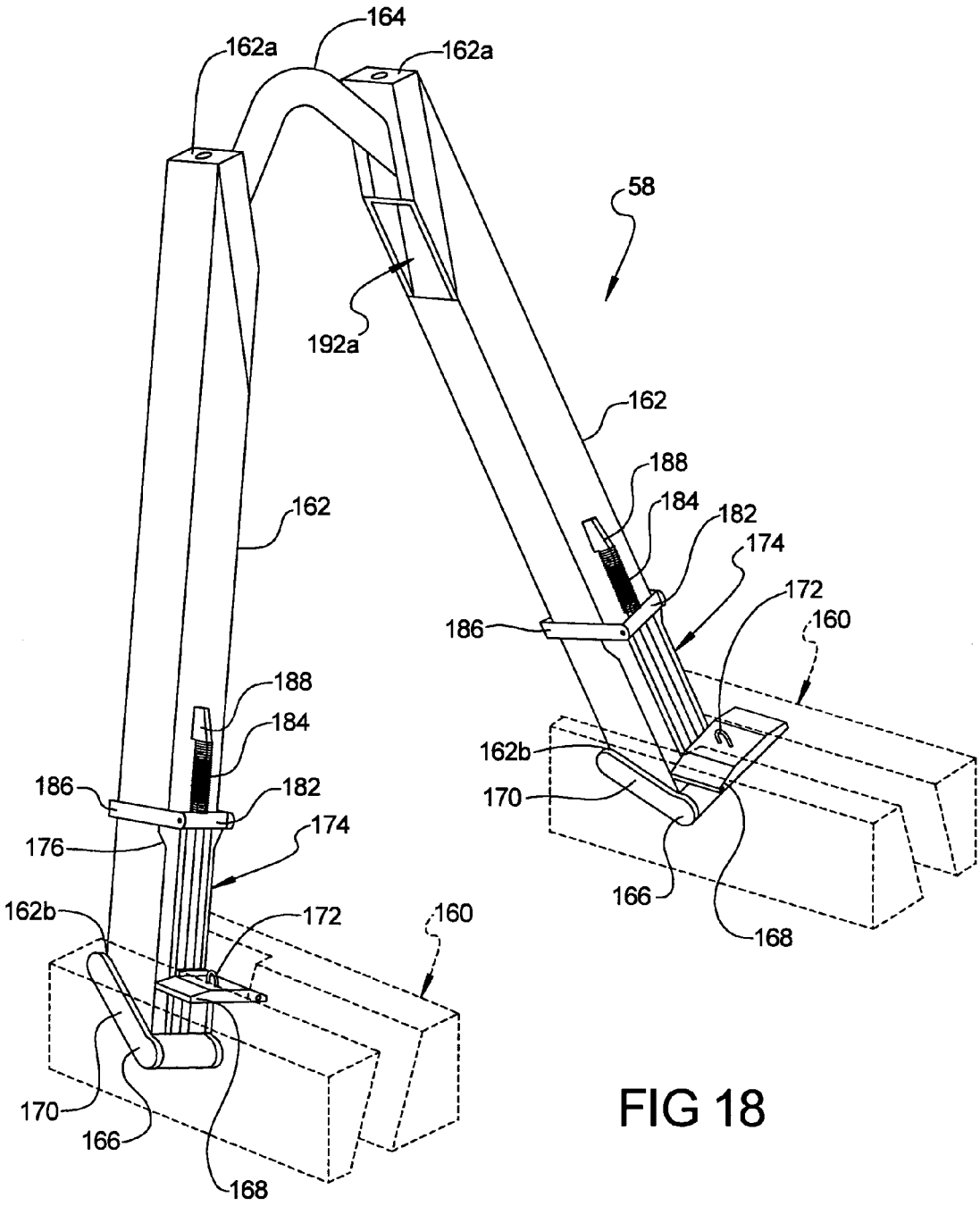
FIG. 18 is a perspective view of a bale arm assembly of the MIP.
Figure 19:
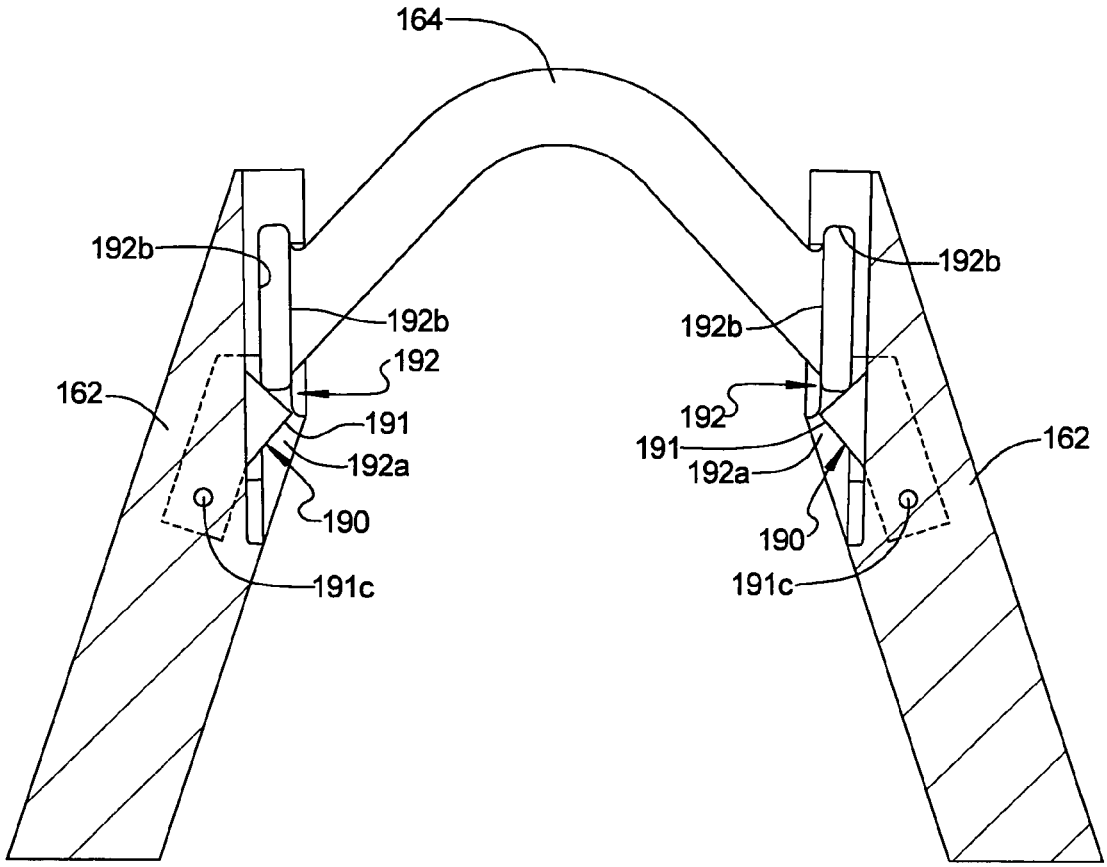
FIG. 19 is a front view of a top portion of the bale arm assembly of the MIP.

Referring now to FIGS. 18-20, the removable bale arm assembly 58 is shown in greater detail. As best seen in FIG. 18, the bale arm assembly 58 includes a pair of bale tracks 160, a pair of support arms 162, and a lateral cross member or bale bar 164 generally extending horizontally between the pair of support arms 162. An optional support member (not shown) could also be fixedly coupled between and near or about a midpoint of a length of the pair of support arms 162. It should be appreciated that the present invention should not be regarded as being limited to only the specifically described configuration, as any arrangement that facilitates interfacing with the load handling system (LHS) of a transporting vehicle or Palletized Load System (PLS) equipped truck is to be regarded as within the scope of the present invention.

The bale tracks 160 are permanently affixed within the MIP 10. Referring to FIGS. 18 and 20, each bale track 160 includes a receiving slot 166 and a cam gate 168. The receiving slot 166 is configured to allow each of the pair of support arms 162 to be coupled to each bale track 160 of the MIP 10. As best shown in FIG. 20A, the receiving slot 166 has a lip 166*a* which is contoured in shape to grab one end of a vertical bar 170 of each support arm 162 to guide the vertical bar 170 of each support arm 162 into position in its associated receiving slot 166. The lip 166*a* also prevents each support arm 162 from being lifted out of the receiving slot 166 in a substantially vertical position, such that each support arm 162 can only be removed by rotating the vertical bar 170 as it is withdrawn out of the receiving slot 166.

As best shown in FIGS. 18 and 20, the cam gate 168 pivots to a plurality of positions including a first fixed or open position and a second fixed or closed position. The first fixed position allows the pair of support arms 162 to be seated within the receiving slots 166. The second fixed position aids in causing friction against each of the pair of support arms 162 to produce a reduced slack connection (FIG. 20). The second fixed position also aids in preventing the vertical bar 170 of each of the pair of support arms 162 from rotating out of the receiving slot 166 in the MIP 10 when the bale arm assembly 58 is lifted upon (FIG. 18). Additionally, the cam gate 168 includes a handle 172 coupled via a bolt (not shown). The handle 172 allows a user to rotate the cam gate 168 between the open and closed positions.

As the pair of support arms 162 is coupled to the bale track 160 and the bale bar 164, a compound angle is formed. The compound angle includes a first angle and a second angle. The first angle is an angle to the center plane, which allows each support arm 162 to form an acute angle near a top 162*a* of each support arm 162 in order to couple to the bale bar 164. The second angle allows the bale arm assembly 58 to lean out over an edge of the MIP 10.

Referring further to FIGS. 18 and 20, each support arm 162 further includes a wedge assembly 174 seated on a stopper base 176. The wedge assembly 174 includes a tightening unit 177 having a wedge head 178 and a pair of extending legs 180, a coupling bar 182, a coil spring 184, a lever device 186, and a hitching device 188. The wedge head 178 is positioned such that an outer edge 178*a* of the wedge head 178 is positioned near or about the bottom 162*b* of the pair of support arms 162. The pair of legs 180 are each coupled to the coupling bar 182. The coupling bar 182 is coupled to the coil spring 184 and the lever device 186. The coil spring 184 in turn is coupled to its associated hitching device 188.

The wedge head 178 has a thick edge 178*b* at one end and is tapered to the outer edge 178*a* at the other end for insertion in the bale track 160 to provide a slack free connection with the cam gate 168. When each support arm 162 is coupled to the bale track 160 and the cam gate 168 is in a closed position, the wedge head 178 is driven down between the cam gate 168 and each support arm 162 to cause friction and prevent the cam gate 168 from being lifted into the open position. The spring 184 also aids in causing friction between the bale track 160 and each support arm 162, since the spring 184 is loaded under compressed force and is biased to press the wedge head 178 in a downward direction. As the wedge head 178 is engaged with the cam gate 168, the spring 184 applies force down that prevents the wedge head 178 from moving in the upward direction. This friction created produces a slack free connection between the cam gate 168 and each support arm 162. As the tightening unit 177 and the cam gate 168 interact and vibrate against one another over time, gravity pulls on the wedge head 178 as the spring 184 pushes the wedge head 178 in a downward direction. This causes an increased in friction between each support arm 162 and the came gate 168 and, thereby reducing any remaining slack between the cam gate 168 and each support arm 162.

Additionally, the lever device 186 allows a user to manually extend and retract the tightening unit 177 by moving the lever device 186 into an engaging position or a retracting position. The engaging position allows the wedge head 178 to be pushed in a downward direction. This causes friction with the cam gate 168 to produce the slack free connection, to thus prevent each support arm 162 from backing out of the receiving slot 166 by engaging the coil spring 184. The retracted position pulls the wedge head 178 in an upward direction, such that friction between each support arm 162 and the bale track 160 is reduced and the cam gate 168 may be placed in the open position.

As shown in FIG. 18, the support arms 162 are removably coupled to the bale track 160 in the MIP 10. Each support arm 162 includes the top 162*a* and a bottom 162*b*, wherein the top 162*a* is coupled to the bale bar 164. The bottom 162*b* is coupled to the bale track 160 within the MIP 10. Coupled to the bottom 162*b* of each support arm 162 is the vertical bar 170 that engages the receiving slot 166 of its bale track 160. The vertical bar 170 is shaped to complement the shape and size of the receiving slot 166.

As best shown in FIG. 19, the bale bar 164 is removably coupled to the pair of support arms 162 via a cam connection 190. Each support arm 162 includes the cam connection 190 having a cam 191 and a T-slot 192. The cam 191 is pivotally coupled within the T-slot 192 at pivot point 191*c*. Additionally, the T-slot 192 includes the aperture 192*a* and a channel 192*b*. The aperture 192*a* is an entrance into the channel 192*b*, where the cam 191 behaves like a door or gate to the aperture 192*a*. The cam 191 is manually pushed upward into a first or open position to allow the bale bar 164 to enter the channel 192*b*. After the bale bar 164 has entered the channel 192*b*, the cam 191 is released and swings into a second or closed position. This causes friction between the T-slot 192 and the cam 191 to prevent the bale bar 164 from sliding out of the T-slot 192 such that the bale bar 164 is adapted for capture by the LHS or PLS truck-loading system 14. This pivotal arrangement permits the cam 191 of each support arm 162 to capture and release the bale bar 164, such that the bale bar 164 may be removed to minimize the overall height of MIP 10, thereby permitting the MIP 10 to be used in smaller cargo aircraft or stored in a shipping container (not shown). As the cam 191 rotates into the second fixed position, a slack free connection is accomplished between the cam 191 and the T-slot 192 to prevent rattling.

As seen in FIG. 1A, during operation the cargo handling system of the transport vehicle 14 grasps the bale bar 164 to lift and roll the MIP 10 (and 10') onto the bed of the aircraft. Once into position near lower cargo door 26 of the transport aircraft, the cargo-handling system of the transport vehicle releases the MIP 10 (and 10') onto lower cargo door 26, according to known loading principles.

Figure 15:
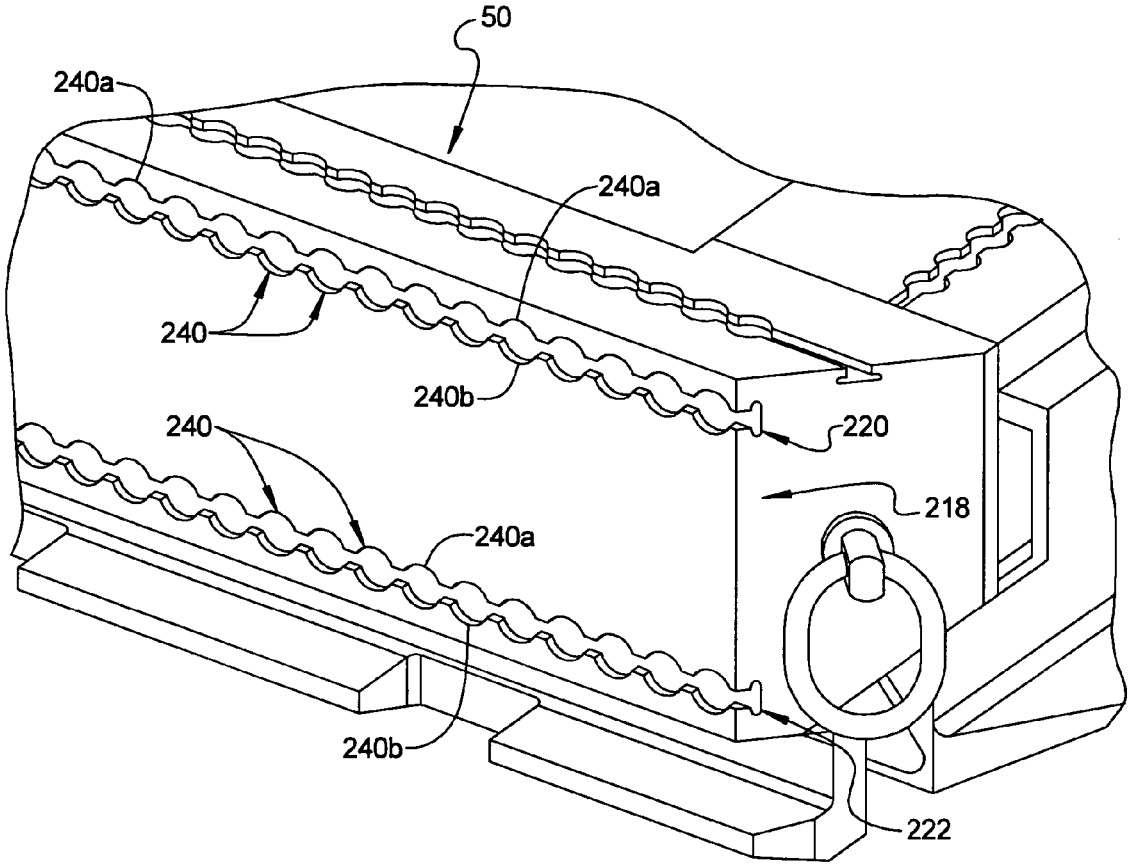
FIG. 15 is an perspective view illustrating a non-matting end of the MIP.
Figure 16:
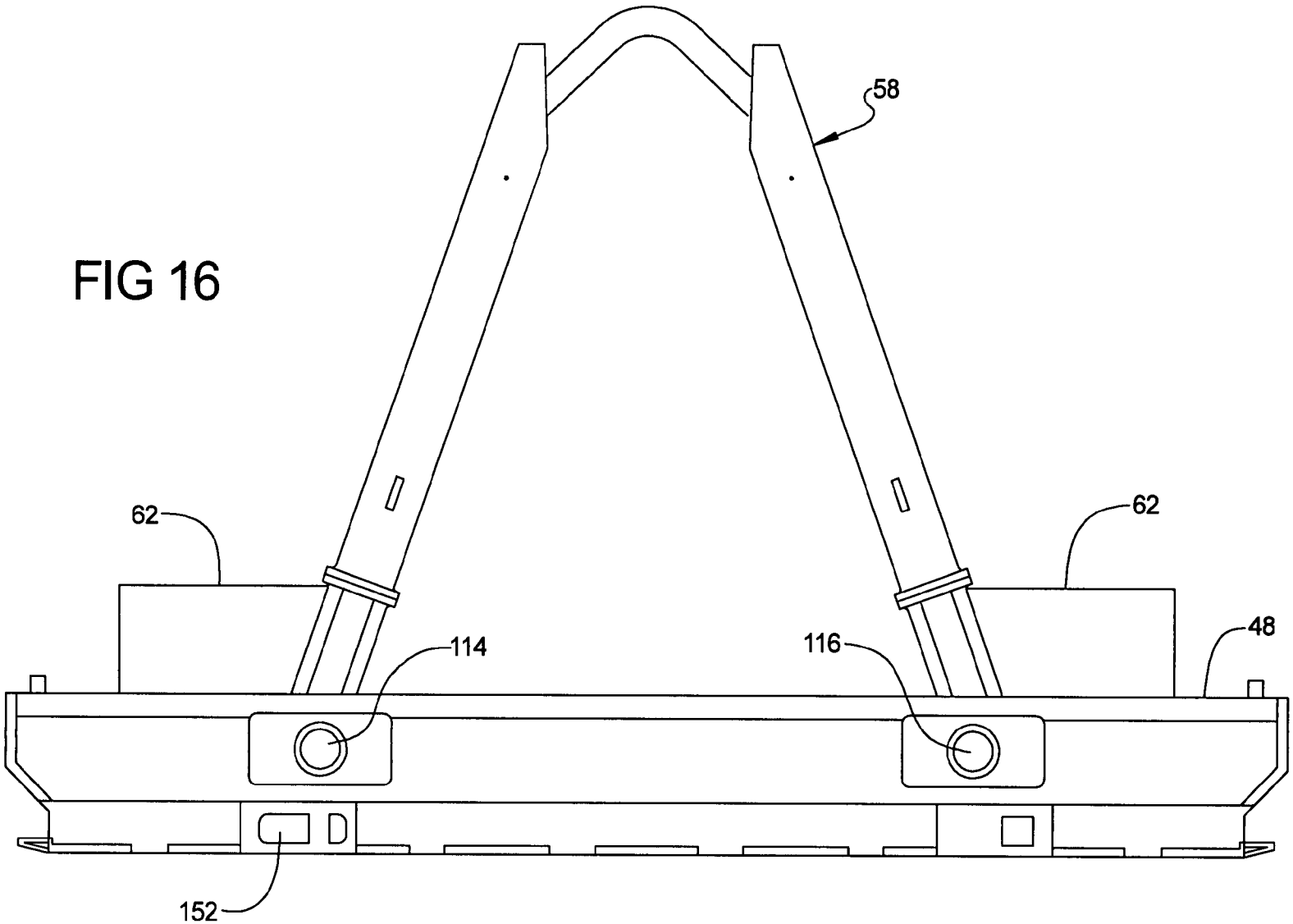
FIG. 16 is an end view of the MIP of FIG. 14.

Referring now to FIGS. 3, 10, 14 and 21, the MIP 10 further includes a plurality of removable adjustable wheel assemblies 62, which is releasably coupled to the MIP 10 at the non-mating end 50, which permits the MIP 10 to roll into or out of a standard ISO container and across the deck of aircraft cargo ramp, K-loader floor, and/or PLS trailer. Referring to FIG. 15, the non-matting end 50 includes a plurality of coupling tracks 218 including a first row of keyed track 220 located near or about top portion of the non-mating end 50 and a second row of keyed track 222 located near or about a lower portion of the non-mating end 50 and inscribed thereto to selectively couple the adjustable wheel assembly 62 to the non-mating end 50 of the MIP 10, according to the aforementioned principles. The first row and second row of keyed track 220, 222 are position substantially horizontal across the non-matting end of the MIP 10. Additionally, the first row of keyed track 220 is positioned a predetermined distance vertically from the second row of keyed track 222. Each inscription 240 includes a top half circle 240*a* on an upper portion of each keyed track 220, 222 that is aligned with a bottom half circle 240*b* of a lower portion of each keyed track 220, 222. Each inscription 240 is spaced a predetermined distance apart from a second inscription 240. At least one inscription 240 of the first row of keyed track 220 is substantially vertically aligned with at least one inscription 240 of the second row of keyed track 222.

Figure 21:
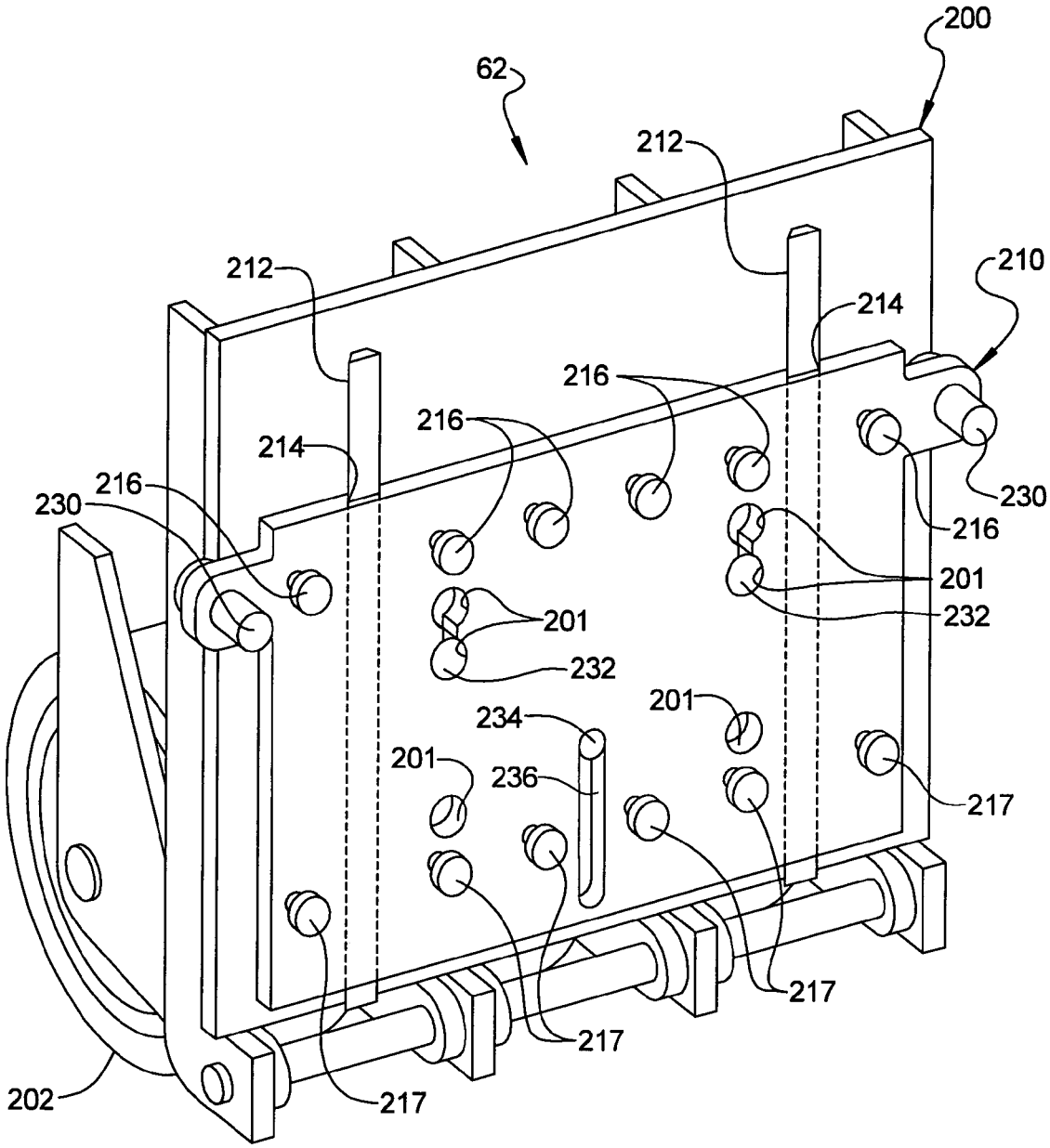
FIG. 21 is a perspective view of a wheel assembly of the MIP.

Referring to FIG. 21, each adjustable wheel assembly 62 includes a pair of generally linear planar bracket members, such as a first bracket member 200 and a second bracket member 210. The first bracket member 200 includes a pair of substantially linear and vertical tracks 212 coupled to a corresponding pair of vertical receiving slots 214 located about the second bracket member 210. The pair of vertical slots 214 allows the pair of vertical tracks 212 to traverse to adjust each wheel assembly 62 to a plurality of height levels. The second bracket member 210 having a plurality of indexing slots 201 vertically and linearly inscribed thereto to selectively couple the first bracket member 200 to the second bracket member 210 via a pair of indexing pins 232 of the first bracket member 200. In other words, the adjustable wheel assemblies 62 are positioned linearly and vertically along the plurality of indexing slots 201 for use in rolling across a PLS trailer or the pair of wheel roller assemblies 202 may be positioned in a generally narrow- stance for rolling on a floor or for storage. Additionally, the first bracket member 200 includes a track bar 234 that extends from the first bracket member 200 through a U-channel 236 of the second bracket member 210. The track bar 234 aids in coupling the first bracket member 200 to the second bracket member 210 and allows the first bracket member 200 to traverse vertically on the second bracket member for a length of the U-channel 236.

Referring to FIGS. 15 and 21, the second bracket member 210 further includes a first plurality of studs 216 aligned substantially horizontal across a top portion of the second bracket member 210 and adapted to slide and incrementally engage with the first row of keyed tracks 220. Additionally, the second bracket member 210 further includes a second plurality of studs 217 aligned about or near a bottom portion of the second bracket member 210 and adapted to slide and incrementally engage with the second row of keyed tracks 222. Each of the plurality of studs 216, 217 rests within one of the inscriptions 240. The second bracket member 210 further includes a pair of spring loaded rods 230. The pair of rods 230 is adapted to lock its respective wheel assembly 62 in a desired position in one of the inscriptions 240 along the first keyed track 220.

Each adjustable wheel assembly 62 further includes preferably a plurality of wheel roller assemblies 202 coupled linearly to the first bracket member 200. Each wheel roller assembly 202 of the wheel assembly 62 includes an independent suspension system (not shown), such that each wheel roller assembly 202 adjusts when encountered with an uneven ground surface during usage of the MIP 10.

In this regard, each wheel assembly 62 may be quickly and conveniently positioned into one of a number of incremental positions (FIG. 21) or detached and stowed away. Accordingly, the MIP 10 may be directly loaded and unloaded by the LHS equipped vehicle 14 directly to or from a C-17, K-loader, or ISO container without the use of material handling equipment or exceeding load bearing footprint capacity, since the load is evenly distributed across the face of several rollers 202. It should be understood that any number of rollers may be used to further distribute these loads.

The modular configuration of MIP 10 provides the ability to attach the necessary equipment, such as the bale arm assembly 58, adjustable wheel assembly 62, or additional MIPs 10', for rapid reconfiguration of loads without unloading each MIP 10. Each MIP 10 is identical and, thus, can be easily mated with an adjoining MIP 10' without the need for special mating platforms. Therefore, by joining and locking adjacent MIPs 10 and attaching the bale arm assembly 58 and adjustable wheel assembly 62*a*, the joined MIP 10*a* can be handled and transported like a full size CROP. However, the joined MIP 10a may also be separated into pallets and transported via forklift, aircraft, etc. without the need to tear down the loads.

The MIP 10*a* may be airdropped as an individual MIP 10 using 88" or 108" airdrop rail systems or as the joined MIP 10*a* using the 88" or 108" logistics rail system of the C-17. When dropped individually, features such as the plurality of heavy lift rings 52 permit MIPs 10 to be drawn together on the ground to form the joined MIP 10*a*, which may be easily removed by the LHS equipped vehicle 14. Without the use of Material Handling Equipment (MHE), any drop zone vehicle may use organic retractable restraint cables 84 attached to the plurality of heavy lift rings 52 to maneuver each MIP 10 in close proximity to another MIP 10' to permit latching of the platforms together.

According to the principles of the present invention, the MIP 10 may comprise a single transportation platform, having a length of about or approximately two standard size pallets or MIPs 10, capable of interfacing with standardized ISO containers, PLS truck-and-trailer systems, and cargo aircraft and an HSV rail and pallet locking system. That is, the MIP 10 may include a pallet interface system that eliminates the need for a married pallet system to be used in the process of loading and supporting CROP type loads being transported on a cargo aircraft.

It will be appreciated that a principal advantage of the present invention is that no crane or K-loader is required to place MIP 10, on the loading ramp of the aircraft. This also allows cargo to be off loaded at airfields where a large crane is not available for removing the cargo-supporting platform from its pallet system.

While various preferred embodiments have been described, those skilled in the art will recognize modifications or variations which might be made without departing from the inventive concept. The examples illustrate the invention and are not intended to limit it. Therefore, the description and claims should be interpreted liberally with only such limitation as is necessary in view of the pertinent prior art.

What is claimed is:

1. A pallet system for loading and supporting cargo, said pallet system comprising:

a first cargo pallet having an upper surface, a lower surface along with a pair of oppositely disposed longitudinal sides and a pair of oppositely disposed ends generally interconnecting said upper surface and said lower surface, said pair of oppositely disposed longitudinal sides having a plurality of forklift slots formed generally within said upper surface and said lower surface, said plurality of forklift slots being operable to receive forks from a fork lifting system for lifting said pallet system; and, a plurality of drop-down rails adaptable to configure said lower surface into a non-flat bottom, wherein each of said drop-down rails can be positioned to align with a roller and restraint system for a transportation vehicle.

2. The pallet system of claim 1, wherein said, plurality of drop-down rails is further adaptable to configure said lower surface into a substantially flat bottom, wherein said drop-down rails are stowed away to allow said lower surface to move over a cargo roller system for a transportation aircraft or vehicle.

3. The pallet system in claim 1, further comprising an extendable rail disposed at about each one of said pair of oppositely disposed longitudinal sides, said extendable rail being operable to extend and retract to thus vary an overall width of said first cargo pallet.

4. The pallet system of claim 1, further comprising a wheel assembly adjustably coupled to at least one of said pair of oppositely disposed ends, said wheel assembly being operable incrementally to adjust a height of said first cargo pallet above a support surface.

5. The pallet system of claim 1, further comprising a bale arm assembly removably coupled to said first cargo pallet and operable to facilitate transportation of said first cargo pallet, said bale arm assembly having a bale bar adapted for removal when said first cargo pallet is placed in a stowed position.

6. The pallet system of claim 1, wherein said first cargo pallet further includes a locking mechanism for coupling to a second cargo pallet.

7. The pallet system of claim 6, wherein said locking mechanism further includes a male connector assembly having a retractable pin configured to mate with a female connector assembly of said second cargo pallet having a pin receptacle, wherein said pin transitions to a first position for mating with said female connector assembly, and to a second, stowed position when not needed.

8. The pallet system of claim 6, wherein said locking mechanism further includes a female connector assembly having a pin receptacle adapted for receiving a pin of said second cargo pallet, wherein said pin receptacle supplies a force to said pin to prevent said pin from being removed from said pin receptacle.

9. A pallet system for loading and supporting cargo, said pallet system comprising:

a cargo pallet having an upper surface, a lower surface along with a pair of opposing ends and a pair of oppositely disposed longitudinal sides generally interconnecting said upper surface and said lower surface, each of said upper surface and said lower surface being substantially planar, said pair of oppositely disposed longitudinal sides having a plurality of forklift slots formed generally between said upper surface and said lower surface, said plurality of forklift slots being operable to receive forks from a fork lifting system for lifting said pallet system; and, a plurality of extendable rails coupled to said pair of oppositely disposed longitudinal sides, operable to extend and retract to thus vary an overall width of said cargo pallet.

10. The pallet system of claim 9, further comprising a wheel assembly removably coupled to said cargo pallet, said wheel assembly adjustably coupled to at least one of said pair of opposing ends.

11. The pallet system of claim 10, wherein said wheel assembly can be adjusted linearly along a track to vary a height at which said cargo pallet is supported above a support surface.

12. The pallet system of claim 9, wherein said lower surface includes a cargo system compatible edge structure having a plurality of notches extending around a width and a length of said lower surface on said pair of opposing ends, as well as along said plurality of extendable rails, wherein said edge structure is compatible with cargo rail systems used in transport vehicles, and wherein said plurality of notches lockingly engages pallet locks on a transport aircraft.

13. The pallet system of claim 9, further comprising a plurality of drop-down rails adaptable to configure said lower surface into a non-planar surface and align with a roller and restraint system for a transportation vehicle.

14. The pallet system of claim 13, wherein said plurality of drop-down rails is further adaptable to configure said lower surface into a substantially planar surface, wherein said drop-down rails are stowed to allow said lower surface to interact with a cargo roller system on a cargo transport aircraft.

15. The pallet system of claim 9, further comprising a plurality of lifting rings generally mounted to said cargo pallet, said plurality of lifting rings being connectable to a lifting device for lifting said pallet system.

16. The pallet system of claim 9, further comprising a collapsible bale arm assembly removably coupled to said cargo pallet and operable to facilitate transportation of said cargo pallet.

17. The pallet system of claim 9, further comprising at least one storage compartment generally formed within said upper surface and said lower surface for storing related pallet or cargo components.

18. A pallet system for loading and supporting cargo, said pallet system comprising:

a cargo pallet having an upper surface, a lower surface along with a pair of oppositely disposed longitudinal sides and a pair of oppositely disposed ends generally interconnecting said upper surface and said lower surface, each of said upper surface and said lower surface being substantially planar, said pair of oppositely disposed longitudinal sides having a plurality of forklift slots formed generally within said upper surface and said lower surface, said plurality of forklift slots being operable to receive forks from a fork lifting system for lifting said pallet system; and, a plurality of wheel assemblies adjustably coupled to at least one of said pair of oppositely disposed ends, said wheel assemblies being operable to adjust in substantial linear increments and perpendicular to a surface, wherein each wheel assembly includes at least one wheel roller assembly having an independent wheel suspension system that allows said at least one wheel roller assembly to adjust for an uneven ground surface.

19. The pallet system of claim 18, further comprising a bale arm assembly removably coupled to at least one of said pair of oppositely disposed ends and operable to facilitate transportation of said cargo pallet.

20. The pallet system of claim 18, further comprising a plurality of drop-down rails adaptable to configure said lower surface into a non-flat surface, wherein said plurality of drop-down rails is configured to align with a roller and restraint system for a transportation vehicle.

21. The pallet system of claim 20, said plurality of drop-down rails is further adaptable to configure said lower surface into a substantially flat surface, wherein said drop-down rails are stowed within said lower surface when not needed to allow said lower surface to interact with cargo roller systems on any conventional transportation aircraft and loader.

22. A pallet system for loading and supporting cargo, said pallet system comprising:

a first cargo pallet having an upper surface, a lower surface along with a pair of oppositely disposed longitudinal sides, and a pair of oppositely disposed ends generally interconnecting said upper surface and said lower surface, each of said upper surface and said lower surface being substantially planar, said pair of oppositely disposed longitudinal sides having a plurality of forklift slots formed generally between said upper surface and said lower surface, said plurality of forklift slots being operable to receive forks from a fork lifting system for lifting said pallet system; and a collapsible bale arm assembly removably coupled to said first cargo pallet, wherein said bale arm assembly is operable to interface with a load handling system of a transporting vehicle.

23. The pallet system of claim 22, wherein said bale arm assembly is configured to collapse for stowage.

24. The pallet system of claim 23, wherein said bale arm assembly includes a bale bar and a plurality of support arms to be individually separated from said first cargo pallet.

25. The pallet system of claim 24, wherein said bale bar is stowed within said first cargo pallet when not needed.

26. The pallet system of claim 24, wherein said support arms are stowed within said first cargo pallet when not needed.

27. The pallet system of claim 22, wherein said first cargo pallet includes at least one bale track configured to couple said bale arm assembly to said first cargo pallet.

28. The pallet system of claim 27, wherein said bale track includes a receiving slot having a lip configured to allow a support arm of said bale arm assembly to rotate into said receiving slot to couple to said first cargo pallet, wherein said lip prevents said bale arm assembly from being lifted out of said receiving slot in a substantially vertical position.

29. The pallet system of claim 27, further includes a gate coupled to said bale track and operable to pivot to a first position to cause friction against said support arm to prevent said support arm from being removed from said bale track.

30. The pallet system of claim 29, wherein said gate is operable to pivot to a second position allowing said support arm of said bale arm assembly to be seated within or removed from said bale track.

31. The pallet system of claim 29, further includes a wedge assembly coupled to said support arm, wherein said wedge assembly is operable to increase friction between said support arm and said gate to produce a slack free connection.

32. The pallet system of claim 22, wherein said first cargo pallet further includes a locking mechanism disposed between said upper surface and said lower surface, operable to couple said first cargo pallet to a second cargo pallet having a mating locking mechanism.

33. The pallet system of claim 32, wherein said locking mechanism comprises a female connecting assembly having a pin receptacle operable to receive a mating male connecting assembly of said second cargo pallet, wherein said second cargo pallet has a mating pin, and wherein said pin receptacle supplies a force to said mating pin to prevent said mating pin from being removed from said pin receptacle.

34. The pallet system of claim 32, wherein said locking mechanism comprises a male connecting assembly having a pin operable to engage a mating female connecting assembly of said second cargo pallet, when said cargo pallet has a mating pin receptacle, and wherein said pin is locked within said mating pin receptacle by a force on said pin that prevents said pin from being removed from said mating pin receptacle.

35. The pallet system of claim 34, wherein when said pin is locked within said mating pin receptacle, said male connecting assembly exerts a force on said pin to reduce gaps between said first cargo pallet and said second cargo pallet, such that a single substantially co-planar cargo pallet is formed.

36. The pallet system of claim 35, wherein said pin transitions to a first position for mating with said mating female connecting assembly, and to a second, stowed position when not in use.

* * * * *